US008805210B2

(12) United States Patent
Mushika

(10) Patent No.: US 8,805,210 B2
(45) Date of Patent: Aug. 12, 2014

(54) USE DETECTION ELEMENT FOR A CARTRIDGE

(75) Inventor: Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 40 days.

(21) Appl. No.: 13/431,077

(22) Filed: Mar. 27, 2012

(65) Prior Publication Data

US 2012/0251216 A1 Oct. 4, 2012

(30) Foreign Application Priority Data

Mar. 31, 2011 (JP) ..... 2011-078638

(51) Int. Cl.
*G03G 15/08* (2006.01)

(52) U.S. Cl.
USPC ..... 399/12

(58) Field of Classification Search
USPC ..... 399/12, 110, 111
See application file for complete search history.

(56) References Cited

U.S. PATENT DOCUMENTS

| | | | | |
|---|---|---|---|---|
| 6,154,619 | A | 11/2000 | Boockholdt et al. | |
| 7,463,834 | B2 | 12/2008 | Takagi et al. | |
| 2006/0193643 | A1 | 8/2006 | Takagi et al. | |
| 2006/0193646 | A1 | 8/2006 | Suzuki et al. | |
| 2007/0140725 | A1 * | 6/2007 | Kamimura | 399/90 |

FOREIGN PATENT DOCUMENTS

| | | | |
|---|---|---|---|
| CN | 201464807 | U | 5/2010 |
| EP | 1 696 278 | A2 | 8/2006 |
| JP | 61-083570 | A | 4/1986 |
| JP | 2001-166648 | A | 6/2001 |
| JP | 2006-243072 | | 9/2006 |
| JP | 2006-267994 | | 10/2006 |

OTHER PUBLICATIONS

Extended European Search Report for European Patent Application No. 12157679.7 mailed Jul. 16, 2012.
First Office Action with Search Report issued in corresponding Chinese Patent Application No. 201210083604.8 mailed Sep. 6, 2013.

* cited by examiner

*Primary Examiner* — Quana M Grainger
(74) *Attorney, Agent, or Firm* — Banner & Witcoff, Ltd.

(57) ABSTRACT

A cartridge which may include a housing, a driving input member provided at the housing wherein the driving input member is configured to be rotated by an externally supplied rotation driving force, and a rotational member configured to receive the rotation driving force, which is transmitted from the driving input member, and be rotated thereby. The cartridge may also include a detection protrusion provided at a position away from a rotational center of the rotational member. The detection protrusion may include a main body protruding from the rotational member away from the housing and a pivot part configured to pivot relative to the main body. The detection protrusion may be configured to be changeable between an extended state and a collapsed state with respect to the rotational member.

14 Claims, 18 Drawing Sheets

USE DETECTION ELEMENT FOR A CARTRIDGE

TECHNICAL FIELD

The present disclosure relates to a cartridge used for an image forming apparatus such as a laser printer.

BACKGROUND

In an example of a laser printer, a developing cartridge is installed in a printer body. Toner is included in the developing cartridge. The toner in the developing cartridge is used to form an image on paper. When the toner in the developing cartridge is exhausted, the developing cartridge is taken out of the printer body, and a new developing cartridge is installed in the printer body. If a paper jam occurs in the printer body, the developing cartridge is taken out of the printer body; after the paper jam has been cleared, the developing cartridge may be installed again in the printer body.

A detecting gear is attached to a side surface of the developing cartridge so as to be rotatable about an axis line (rotational axis line) extending in a direction orthogonal to the side surface. The detecting gear has a plate-like detecting gear body and an abutting protrusion formed integrally with the detecting gear body, the abutting protrusion being disposed on an outer side of the detecting gear (on a side of the detecting gear body opposite to the side surface of the developing cartridge). Gear teeth are formed on the circumferential surface of the detecting gear except some portion of the circumferential surface.

With a new developing cartridge, the gear teeth of the detecting gear are engaged with the gear teeth of a transmission gear. When the developing cartridge is installed in the printer body, the driving force of a motor is supplied to the transmission gear, and the driving force is transmitted from the transmission gear to the detection gear through their gear teeth.

Thus, the detection gear rotates, and the abutting protrusion of the detecting gear moves in the rotational direction of the detecting gear due to the rotation of the detecting gear. When the detecting gear further rotates and a missing tooth portion of the detecting gear faces the gear teeth of the transmission gear, the engagement between the gear teeth of the transmission gear and the gear teeth of the detecting gear is released, stopping the rotation of the detecting gear. Accordingly, after the developing cartridge has been installed in the printer body even once, the engagement between the gear teeth of the transmission gear teeth of the gear teeth of the detecting gear is released and the disengaged state is kept after that.

In the printer body, a sensor that detects the passage of the abutting protrusion is provided, regarding the abutting protrusion as a protrusion to be detected. Whether the developing cartridge is a new one or an old one is determined depending on whether the sensor has detected the passage of the abutting protrusion. Specifically, after the developing cartridge has been installed in the printer body, if the passage of the abutting protrusion is detected by the sensor, the developing cartridge is determined to be new. However, after the developing cartridge has been installed in the printer body, if the passage of the abutting protrusion is not detected by the sensor, the developing cartridge is determined to be old.

If, however, an amount by which the abutting protrusion protrudes from the side surface of the developing cartridge is large, when the developing cartridge is installed in or removed from the printer body, the abutting protrusion may rub against a member in the printer body and may wear out.

Further, with the large amount of protrusion of the abutting protrusion is that when the developing cartridge is installed in or removed from the printer body, the abutting protrusion may come into contact with a member in the printer body or may be caught by the member and the abutting protrusion and/or the member in the printer body may thereby be damaged.

SUMMARY

Aspects of the disclosure provide a cartridge that can reduce the wear of a protrusion to be detected. For example, in an illustrative embodiment of the disclosure, a cartridge which may include a housing, a driving input member provided at the housing wherein the driving input member is configured to be rotated by an externally supplied rotation driving force, and a rotational member configured to receive the rotation driving force, which is transmitted from the driving input member, and be rotated thereby. The cartridge may also include a detection protrusion provided at a position away from a rotational center of the rotational member. The detection protrusion may include a main body protruding from the rotational member away from the housing and a pivot part configured to pivot relative to the main body. The detection protrusion may be configured to be changeable between an extended state and a collapsed state with respect to the rotational member.

Accordingly, if the detection protrusion is in the collapsed state when, for example, the cartridge is installed in or removed from the main body casing, contact of the detection protrusion with other members can be reduced and the wear and damage of the detection protrusion due to the contact can be reduced.

Aspects of the disclosure may relate to a cartridge which may include a housing, a driving input member provided at the housing wherein the driving input member is configured to be rotated by an externally supplied rotation driving force, and a rotational member configured to receive the rotation driving force, which is transmitted from the driving input member, and be rotated thereby. The cartridge may also include a cover attached to the housing wherein the cover has an opposite part that faces the rotational member and a detection protrusion provided at a position away from a rotational center of the rotational member. The detection protrusion may include a main body which protrudes from a face of the rotational member and a pivot part configured to pivot relative to the main body. The detection protrusion may be configured to be changeable between an extended state and a collapsed state. At an initial position, which is a position before the rotational member is rotated, and at a terminal position, which is a position after the rotational member has completed rotating, the opposite part of the cover may contact the detection protrusion and configure to change the detection protrusion from the collapsed state to the extended state. At a point between the initial position and the terminal position, the detection protrusion may extend through a hole in the opposite part of the cover and assume the extended state.

Aspects of the disclosure may relate to cartridge which may include a housing, a driving input member provided at the housing wherein the driving input member is configured to be rotated by an externally supplied rotation driving force, and a rotational member configured to receive the rotation driving force, which is transmitted from the driving input member, and be rotated thereby. The cartridge may also include a cover attached to the housing wherein the cover has an opposite part that faces the rotational member and a detection protrusion provided at a position away from a rotational center of the rotational member. The detection protrusion may be configured to be changeable between an extended state in which the pivot part is positioned at first orientation relative to the main body, and a collapsed state in which the pivot part is positioned at second orientation relative to the main body, which is different that the first orientation. At least a portion of the detection protrusion may be configured to pivot about a pivotal axis that is substantially parallel to a face of the rotational member that faces the cover in order to assume each of the extended state and the collapsed state.

DETAILED DESCRIPTION

An embodiment of the present disclosure will be described below in detail with reference to the attached drawings.

1. Entire Structure of a Laser Printer

Figure 1:
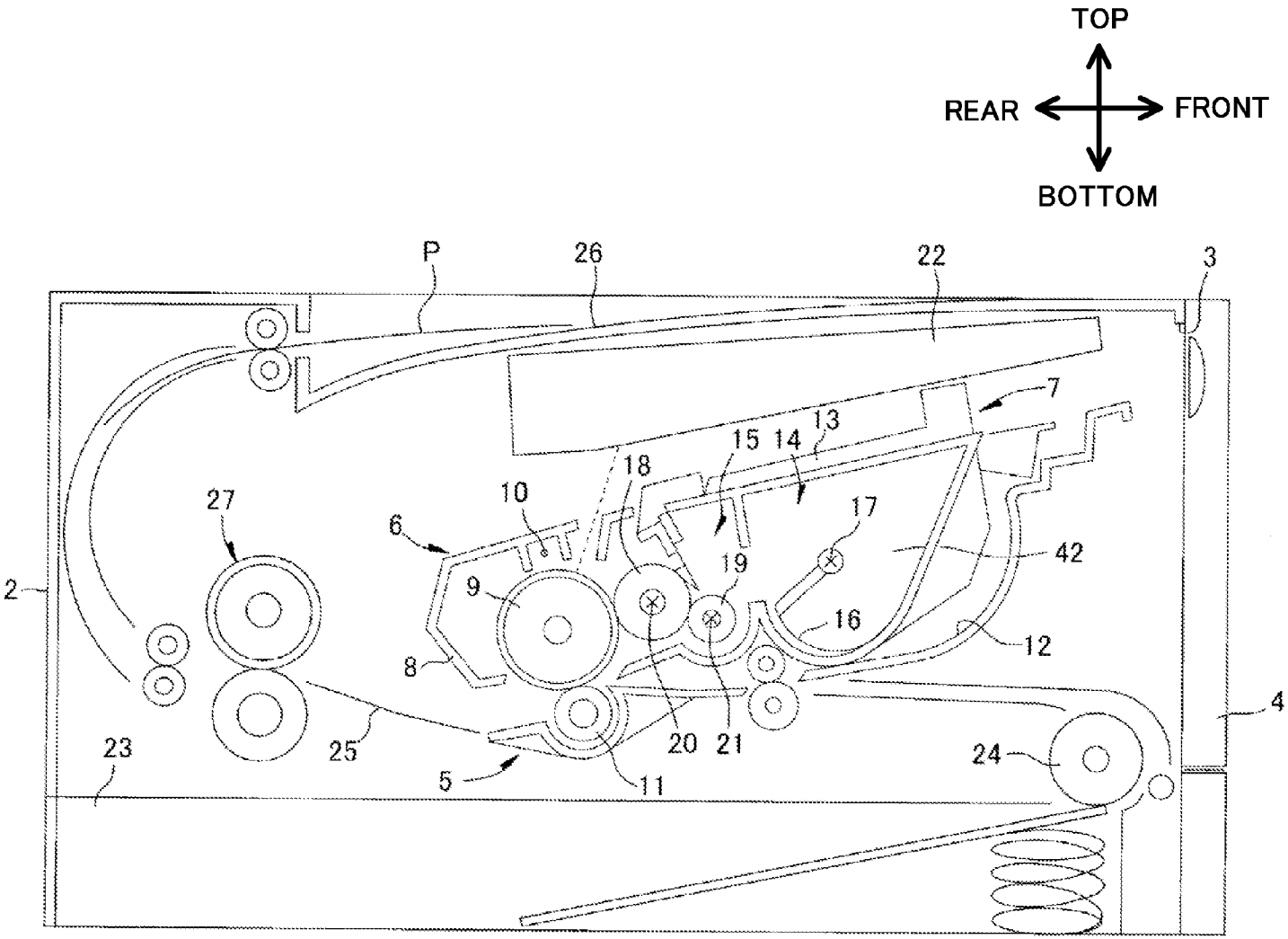
FIG. 1 is a cross-sectional view of a laser printer in which a developing cartridge according to an embodiment of the present disclosure is installed.

As illustrated in FIG. 1, a laser printer 1 has a main body casing (printer body) 2. A side wall at the front of the main body casing 2 has a cartridge installing/removing port 3 and a front cover 4 that opens and closes the installing/removing port 3.

The front of the laser printer 1 is on the forward side in the fore-aft direction. The upper sides, lower sides, right sides, and left sides of the laser printer 1 placed on a flat surface and a developing cartridge 7 (described later) installed in the main body casing 2 of the laser printer 1 are defined as viewed from the front.

A process cartridge 5 is installed at a position a little apart from the center in the main body casing 2 toward the front. The process cartridge 5 is inserted into the main body casing 2 through the installing/removing port 3 with the front cover 4 open, and is removed from the main body casing 2.

The process cartridge 5 has a drum cartridge 6 and the developing cartridge 7, which is an example of a cartridge that is removably installed in the drum cartridge 6.

The drum cartridge 6 has a drum frame 8. A photosensitive drum 9 is rotatably held at the rear end of the drum frame 8. A charger 10 and a transfer roller 11 are held in the drum frame 8. The charger 10 is disposed above the photosensitive drum 9 and the transfer roller 11 is disposed below the photosensitive drum 9.

In the drum frame 8, a portion in front of the photosensitive drum 9 is a cartridge installation part 12. The developing cartridge 7 is installed in the cartridge installation part 12.

The developing cartridge 7 has a housing 13 in which toner is included. A toner room 14 and a developing room 15, which mutually communicate, are adjacently formed fore and aft in the housing 13.

An agitator 16 is provided in the toner room 14 so as to be rotatable about an agitator rotational axis line 17 extending in the right and left direction. The toner in the toner room 14 is stirred by the rotation of the agitator 16 and is fed from the toner room 14 to the developing room 15.

In the developing room 15, a developing roller 18 is provided so as to be rotatable about a developing rotational axis line 20 extending in the right and left direction and a supply roller 19 is also provided so as to be rotatable about a supply rotational axis line 21 extending in the right and left direction.

The developing roller 18 is disposed so that part of its circumferential surface is exposed from the rear end of the housing 13. The developing cartridge 7 is installed in the drum cartridge 6 so that the circumferential surface of the developing roller 18 comes into contact with the circumferential surface of the photosensitive drum 9.

The supply roller 19 is disposed so that its circumferential surface comes into contact with the circumferential surface of the developing roller 18 from its lower side on the front side. The toner in the developing room 15 is supplied by the supply roller 19 to the circumferential surface of the developing roller 18 and is supported on the circumferential surface of the developing roller 18 as a thin layer.

In the main body casing 2, an exposure unit 22 including a laser and the like is disposed above the process cartridge 5.

During the formation of an image, the photosensitive drum 9 is rotated at a fixed speed clockwise as viewed from the left side. The circumferential surface (front surface) of the photosensitive drum 9 is uniformly charged due to the discharging of the charger 10 when the photosensitive drum 9 rotates. The exposure unit 22 is controlled according to image data, and a laser beam is emitted from the exposure unit 22. For example, the laser printer 1 is connected to a personal computer (not shown), and the image data is sent from the personal computer to the laser printer 1. The laser beam passes between the charger 10 and the developing cartridge 7 and is incident on the uniformly charged circumferential surface of the photosensitive drum 9, selectively exposing the circumferential surface of the photosensitive drum 9. This exposure selectively removes charges from exposed parts of the photosensitive drum 9, forming an electrostatic latent image on the circumferential surface of the photosensitive drum 9. When the photosensitive drum 9 rotates and the electrostatic latent image faces the developing roller 18, toner is supplied from the developing roller 18 to the electrostatic latent image and the electrostatic latent image is developed as a toner image.

A paper supply cassette 23 that stores paper P is provided at the bottom of the main body casing 2. A pickup roller 24 used to feed out paper from the paper supply cassette 23 is provided above the paper supply cassette 23.

A transport path 25, which is S-shaped as viewed from a side, is formed in the main body casing 2. The transport path 25 extends from the paper supply cassette 23 through the photosensitive drum 9 and transfer roller 11 to a paper ejection tray 26 formed on the upper surface of the main body casing 2.

The toner image on the circumferential surface of the photosensitive drum 9 is transferred to the paper P that passes between the photosensitive drum 9 and the transfer roller 11 by the effect of a bias applied to the transfer roller 11.

On the transport path 25, a fixing unit 27 is provided downstream of the transfer roller 11 in the direction in which the paper P is transported. The paper P on which the toner image has been transferred is transported along the transport path 25 and passes through the fixing unit 27. In the fixing unit 27, the toner image is heated and pressurized to fix it to the paper P as an image. The paper P, on which the image has been formed in this way, is further transported along the transport path 25 and is ejected onto the paper ejection tray 26.

2. Developing Cartridge 2-1. Housing

Figure 2:
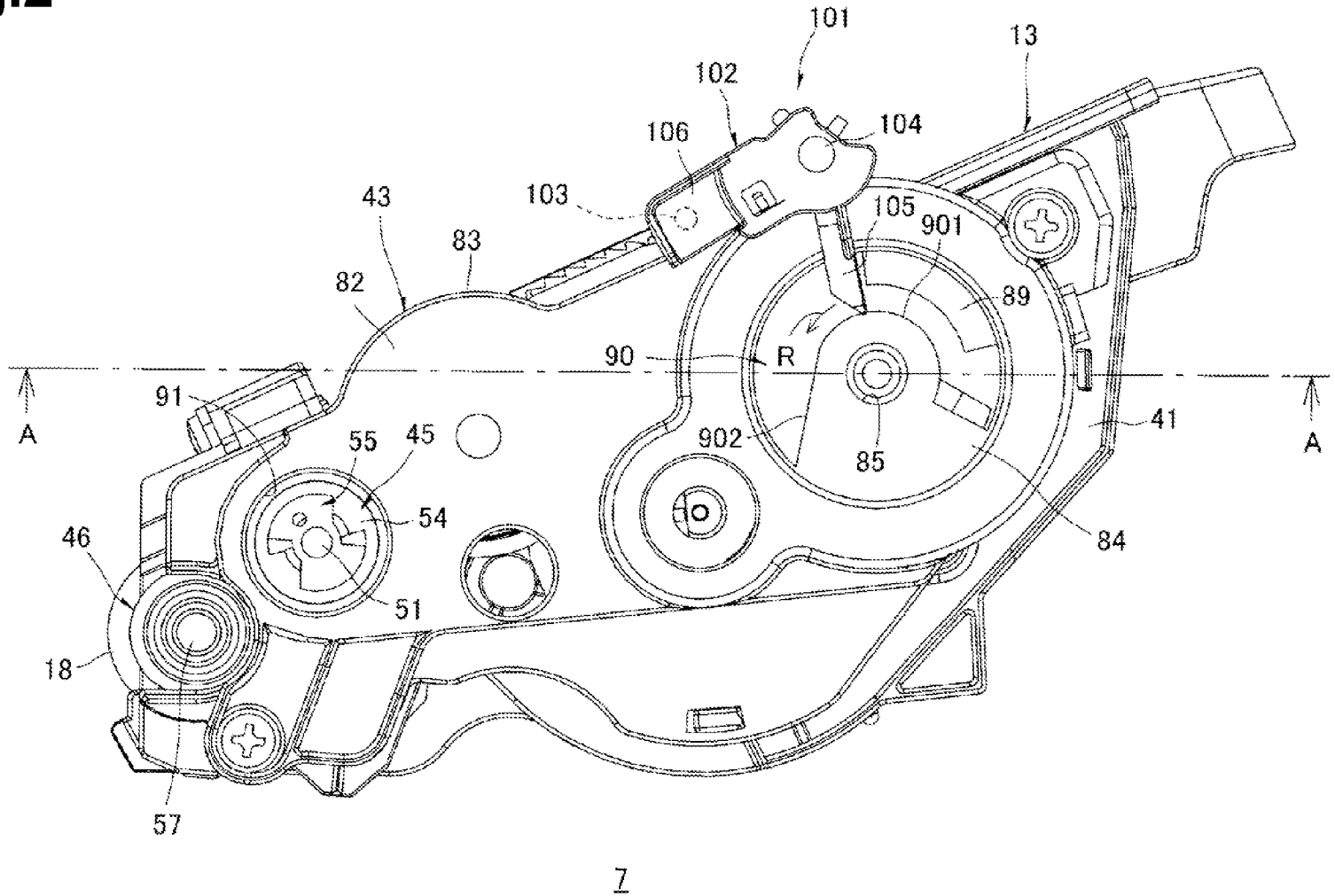
FIG. 2 is a left side view of the developing cartridge, indicating a state in which a detection protrusion is positioned at an initial position.

The housing 13 of the developing cartridge 7 has a first side wall 41 (see FIG. 2) and a second side wall 42 (see FIG. 1) that face each other with a spacing therebetween in the right and left direction, as shown in FIGS. 1 and 2.

2-2. Gear Train

Figure 3:
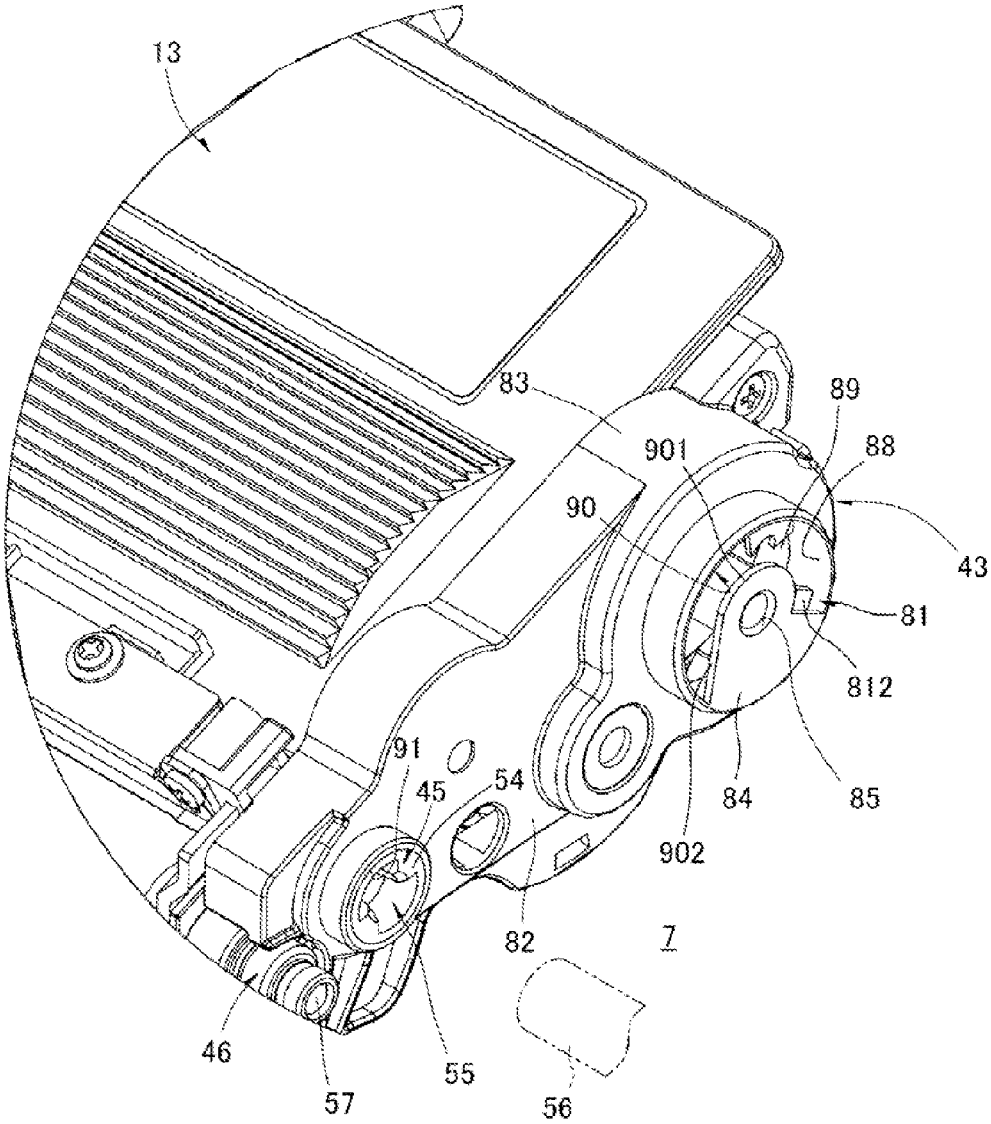
FIG. 3 is a perspective view at the left end of the developing cartridge illustrated in FIG. 2, as viewed from above at the back on the left side.
Figure 4:
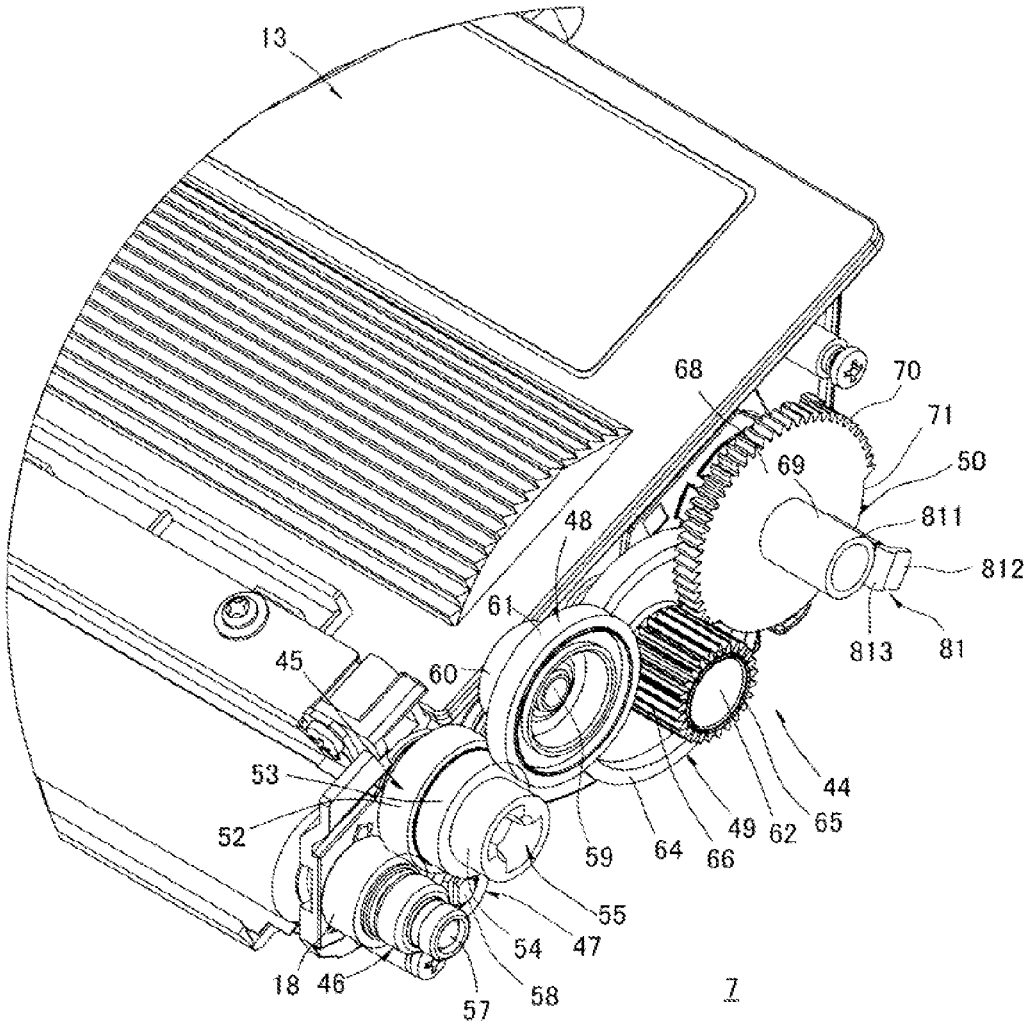
FIG. 4 is a perspective view at the left end of the developing cartridge illustrated in FIG. 2, as viewed from above at the back on the left side, indicating a state in which a gear cover is removed.

A gear cover 43 is attached to the external side surface (left surface) of the first side wall 41 used as an example of a cover, as shown in FIGS. 2 and 3. A gear train 44 is provided inside the gear cover 43, as shown in FIG. 4. The gear train 44 includes an input gear 45 used as an example of a driving input member, a developing gear 46, a supply gear 47, an intermediate gear 48, an agitator gear 49 used as an example of a transmitting member, and a reset gear 50 used as an example of a rotating member.

2-2-1. Input Gear

The input gear 45 is positioned at an upper portion at the rear end of the first side wall 41. The input gear 45 is disposed so as to be rotatable about an input gear rotational axis 51 (see FIG. 2) that extends in the right and left direction. The input gear rotational axis 51 is held to the first side wall 41 so as not to be rotatable.

The input gear 45 integrally has a large-diameter gear part 52, a small-diameter gear part 53, and a coupling part 54 as shown in FIG. 4. The large-diameter gear part 52, small-diameter gear part 53, and coupling part 54 are placed in that order from the same side as the first side wall 41.

The large-diameter gear part 52 is formed in a discoid shape, which has a central axis line that matches the central axis line of the input gear rotational axis 51. Many gear teeth are formed over the entire circumferential surface of the large-diameter gear part 52.

The small-diameter gear part 53 is formed in a discoid shape, which has a central axis line that matches the central axis line of the input gear rotational axis 51, the small-diameter gear part 53 having a smaller diameter than the large-diameter gear part 52. Many gear teeth are formed over the entire circumferential surface of the small-diameter gear part 53.

The coupling part 54 is formed in a columnar shape, which has a central axis line that matches the central axis line of the input gear rotational axis 51, the circumferential surface of the coupling part 54 having a smaller diameter than the circumferential surface of the small-diameter gear part 53. A linkage recess 55 is formed in the left side surface of the coupling part 54. With the developing cartridge 7 installed in the main body casing 2, the distal end of a driving output member 56 (see FIG. 3) provided in the main body casing 2 is inserted into the linkage recess 55.

The driving output member 56 is provided so as to be advanceable and retractable in the right and left direction. With the developing cartridge 7 installed in the main body casing 2, the driving output member 56 advances to the right and its distal end is inserted into the linkage recess 55. Thus, the driving output member 56 and linkage recess 55 are mutually joined so as not to be relatively rotatable. When the driving output member 56 is rotated, therefore, the rotational force of the driving output member 56 is received by the input gear 45 as a driving force and the input gear 45 is thereby rotated together with the driving output member 56.

2-2-2. Developing Gear

The developing gear 46 may be placed below and behind the input gear 45 as shown in FIG. 4. The developing gear 46 is attached to a developing roller axis 57 of the developing roller 18 so as not to be relatively rotatable. The developing roller axis 57 is rotatably attached to the first side wall 41; the central axis line of the developing roller axis 57 is the developing rotational axis line 20 (see FIG. 1), which is the rotational axis line of the developing roller 18. Gear teeth are formed over the entire circumferential surface of the developing gear 46; the gear teeth have been engaged with the gear teeth of the large-diameter gear part 52 of the input gear 45.

2-2-3. Supply Gear

The supply gear 47 may be placed below the input gear 45 as shown in FIG. 4. The supply gear 47 is attached to a supply roller axis 58 of the supply roller 19 (see FIG. 1) so as not to be relatively rotatable. The supply roller axis 58 is rotatably attached to the first side wall 41; the central axis line of the supply roller axis 58 is the supply rotational axis line 21 (see FIG. 1), which is the rotational axis line of the supply roller 19. Gear teeth are formed over the entire circumferential surface of the supply gear 47; the gear teeth of the supply gear 47 be engaged with the gear teeth of the large-diameter gear part 52 of the input gear 45.

2-2-4. Intermediate Gear

The intermediate gear 48 may be placed above and in front of the input gear 45 as shown in FIG. 4. The intermediate gear 48 is disposed so as to be rotatable about the central axis line of an intermediate gear rotational axis 59 extending in the right and left direction. The intermediate gear rotational axis 59 is held to the first side wall 41 so as not to be rotatable.

The intermediate gear 48 integrally has a small-diameter part 60, which is formed in a discoid shape with a relatively small outer diameter, and a large-diameter part 61, which is formed in a columnar shape with a relatively large outer diameter, as shown in FIG. 3. The small-diameter part 60 and large-diameter part 61 are placed in that order from the same side as the first side wall 41. The central axis lines of the small-diameter part 60 and large-diameter part 61 match the central axis line of the intermediate gear rotational axis 59.

Gear teeth are formed over the entire circumferential surface of the small-diameter part 60.

Gear teeth are formed over the entire circumferential surface of the large-diameter part 61; the gear teeth of the large-diameter part 61 have been engaged with the gear teeth of the small-diameter gear part 53 of the input gear 45.

2-2-5. Agitator Gear

The agitator gear 49 may be placed below and in front of the intermediate gear 48 as shown in FIG. 4. The agitator gear 49 is attached to an agitator rotational axis 62 so as not to be relatively rotatable. The agitator rotational axis 62 passes through the first side wall 41 and second side wall 42 (see FIG. 1) in the right and left direction and is rotatably held to the first side wall 41 and second side wall 42. In the housing 13, the agitator 16 is attached to the agitator rotational axis 62. Accordingly, the agitator 16 and agitator gear 49 use the central axis line of the agitator rotational axis 62 as the agitator rotational axis line 17 (see FIG. 1), so they are rotatable together with the agitator rotational axis 62.

The agitator gear 49 integrally has a large-diameter gear part 64 and a small-diameter gear part 65.

The large-diameter gear part 64 is formed in a discoid shape, which has a central axis line that matches the central axis line of the agitator rotational axis 62. Gear teeth are formed over the entire circumferential surface of the large-diameter gear part 64. The gear teeth of the large-diameter gear part 64 have been engaged with the gear teeth of the small-diameter part 60 of the intermediate gear 48.

The small-diameter gear part 65 is formed on a side opposite to the first side wall 41 with respect to the large-diameter gear part 64, has a discoid shape, which has a central axis line that matches the central axis line of the agitator rotational axis 62, and has a smaller diameter than the large-diameter gear part 64. Gear teeth 66 are formed over the entire circumferential surface of the small-diameter gear part 65.

2-2-6. Reset Gear

Figure 5:
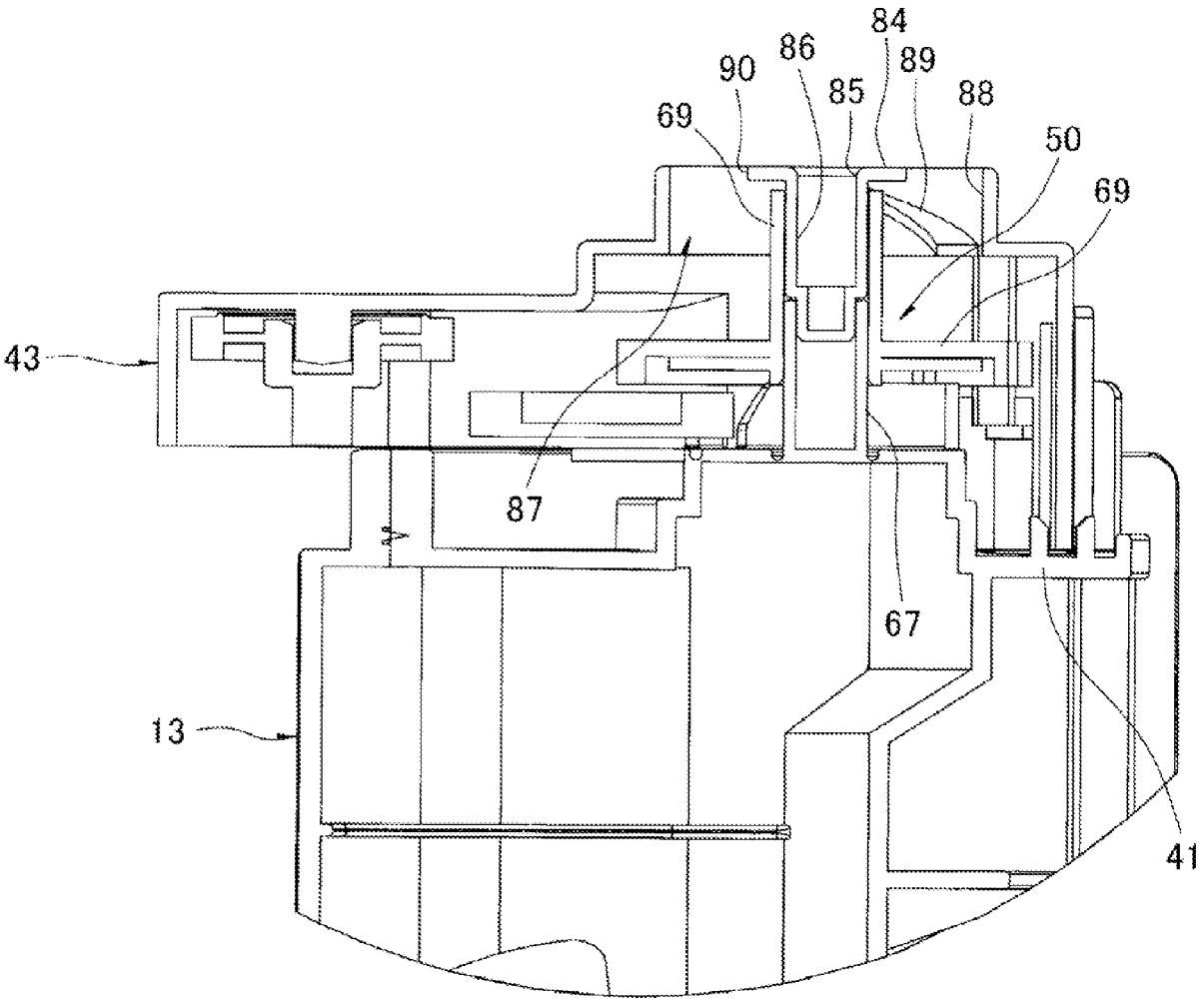
FIG. 5 is a cross sectional view taken along cutting-plane line A-A indicated in FIG. 2.
Figure 6:
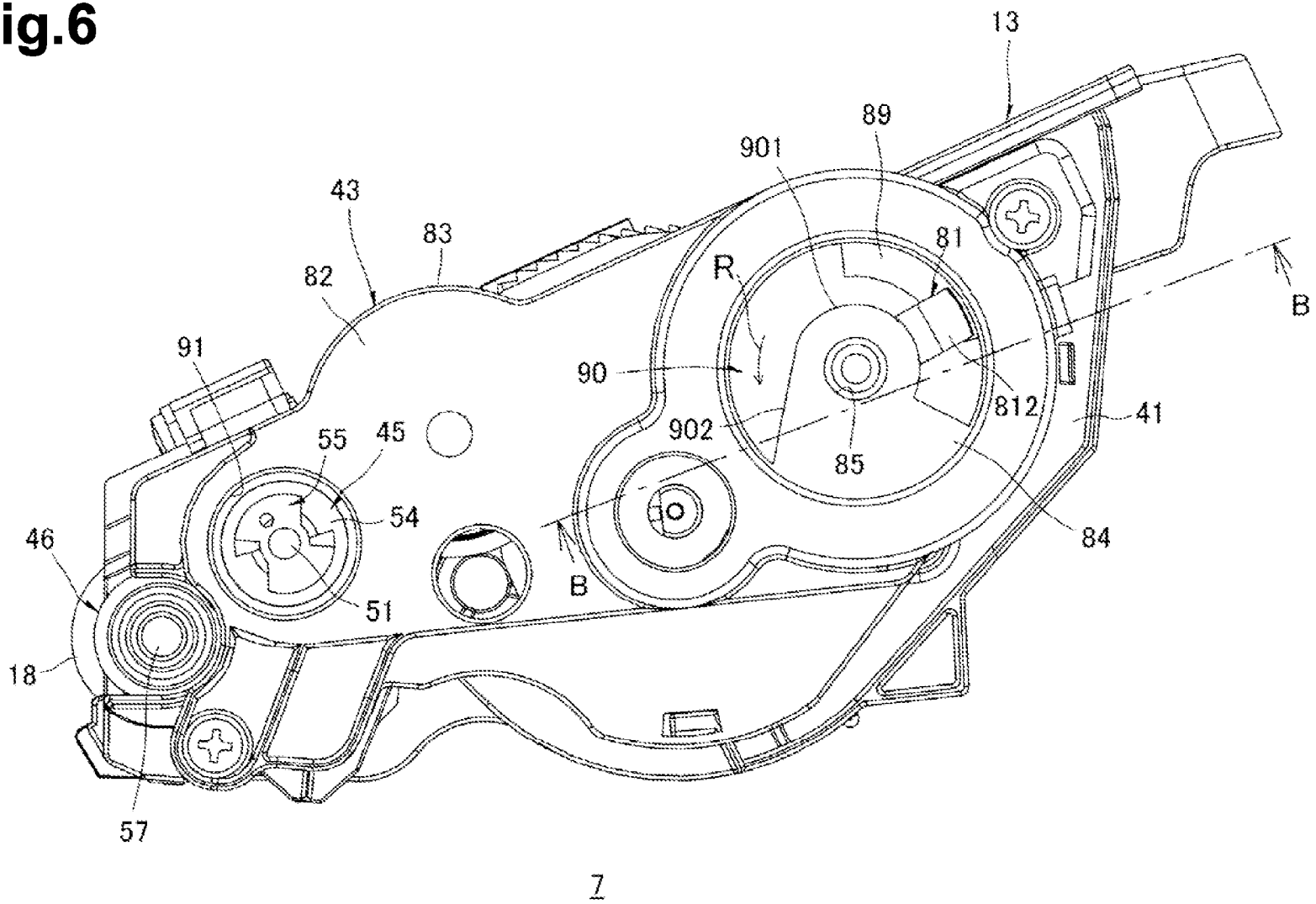
FIG. 6 is a left side view of the developing cartridge, indicating a state in which the detection protrusion is positioned at an intermediate position between the initial position and a terminal position.
Figure 7:
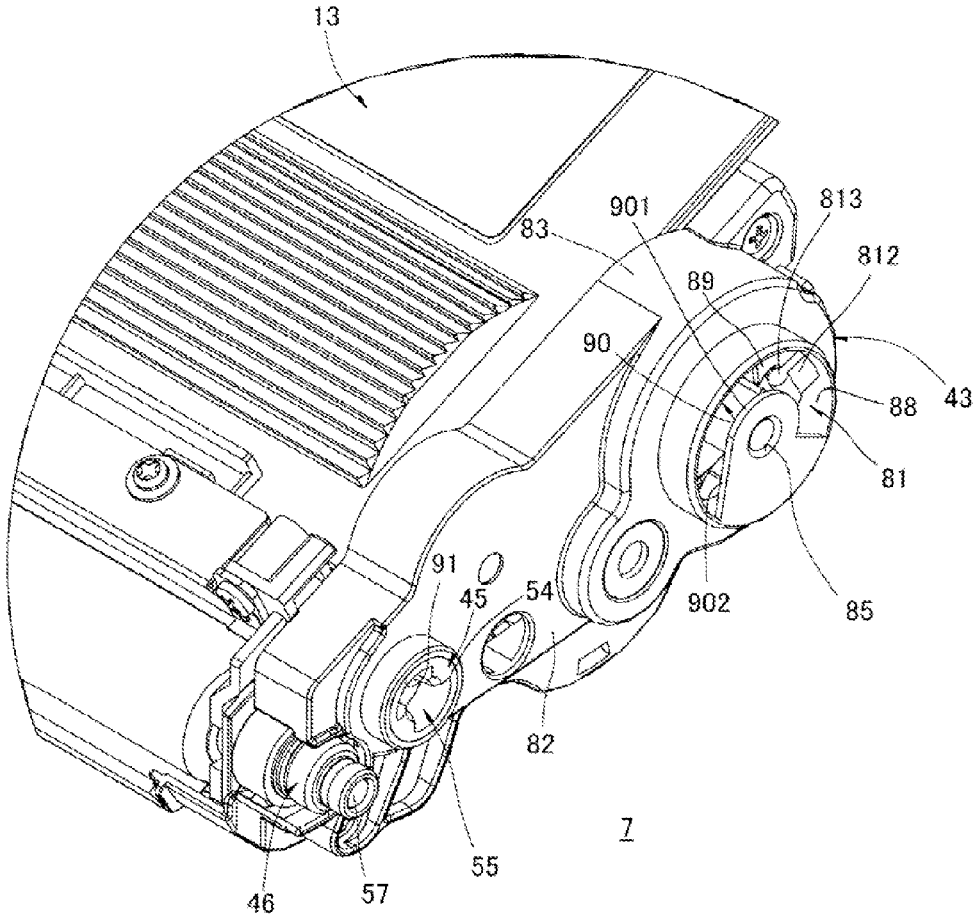
FIG. 7 is a perspective view at the left end of the developing cartridge illustrated in FIG. 6, as viewed from above at the back on the left side.
Figure 8:
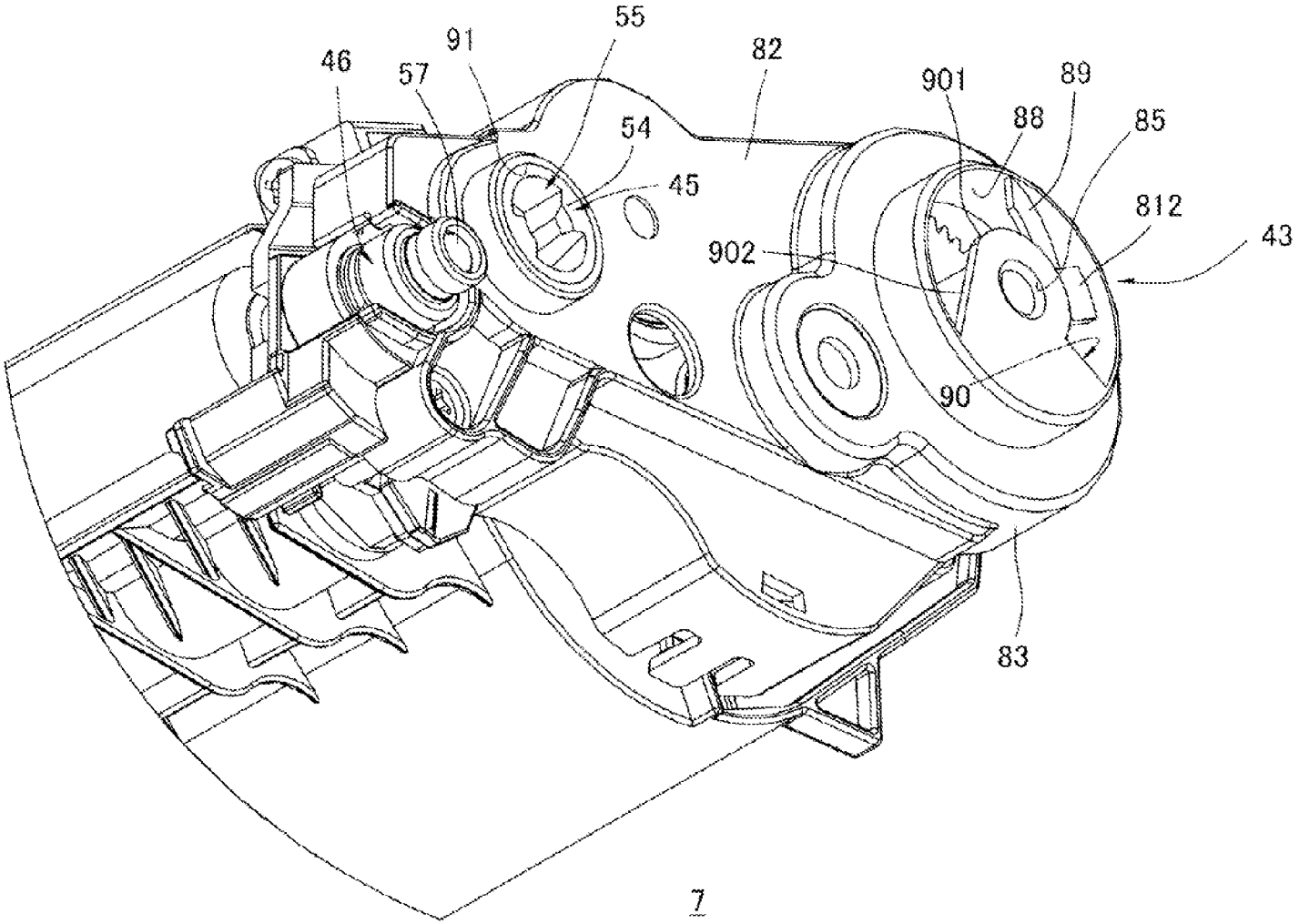
FIG. 8 is a perspective view at the left end of the developing cartridge illustrated in FIG. 6, as viewed from the bottom at the back on the left side.
Figure 9:
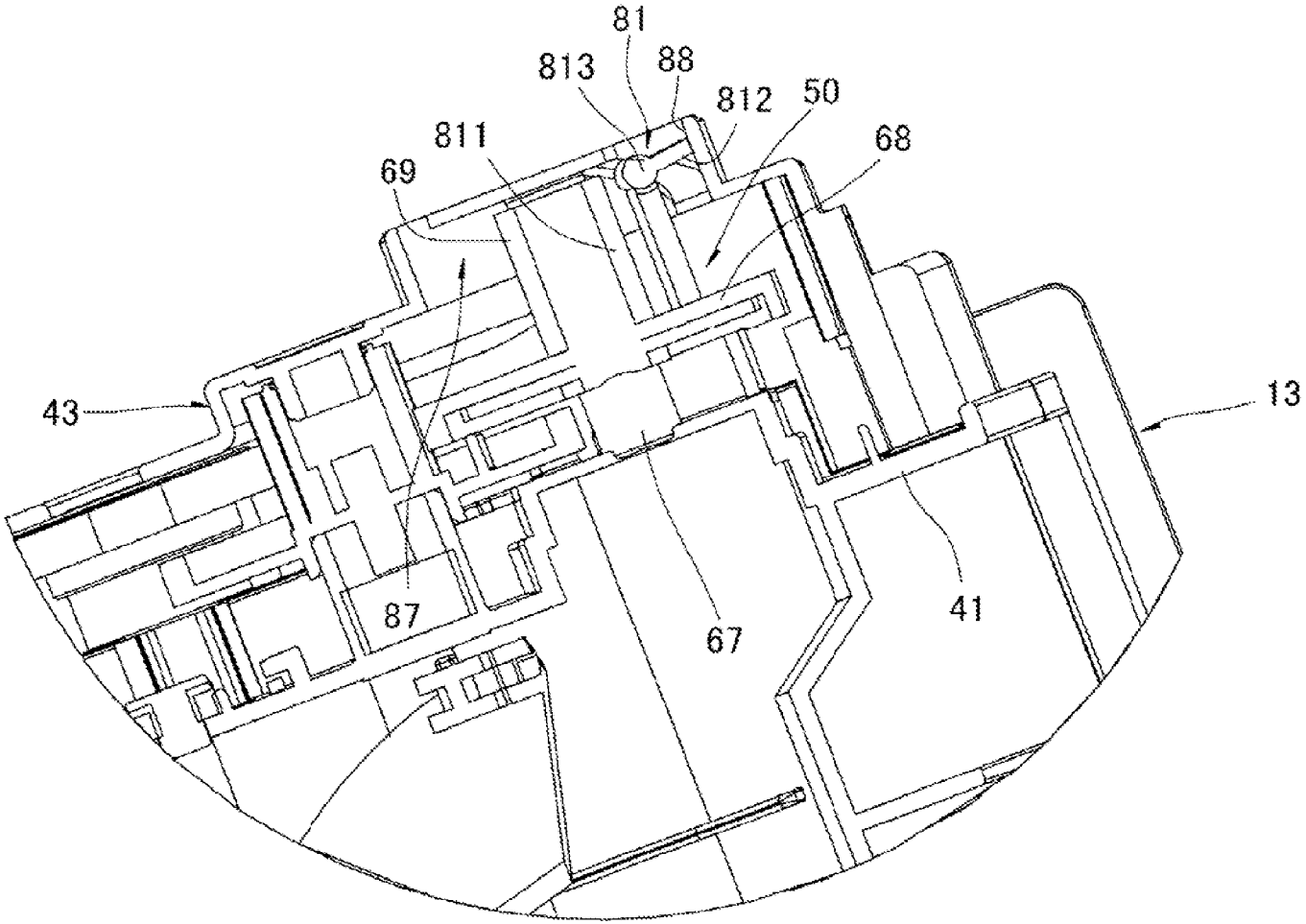
FIG. 9 is a cross sectional view taken along cutting-plane line B-B indicated in FIG. 6.

The reset gear 50 may be placed above and in front of the agitator gear 49 as shown in FIG. 4. The reset gear 50 is disposed so as to be rotatable about a rotational axis 67 extending in the right and left direction, as shown in FIG. 5. The rotational axis 67 is held to the first side wall 41 so as not to be rotatable.

The reset gear 50 integrally has a missing tooth gear part 68 used as an example of a passive part and a cylindrical boss 69, which is cylindrical.

The missing tooth gear part 68 is formed in a discoid shape, which has a central axis line that matches the central axis line of the rotational axis 67. Gear teeth 70 are formed on part of the circumferential surface of the missing tooth gear part 68. Specifically, a portion having a central angle of about 185 degrees is formed on the circumferential surface of the missing tooth gear part 68 as a missing tooth part 71, and gear teeth 70 are formed on a portion having a central angle of about 175 degrees outside the missing tooth part 71. The gear teeth 70 are engaged with the gear teeth 66 of the small-diameter gear part 65 of the agitator gear 49 at some rotational position of the reset gear 50.

The cylindrical boss 69, which protrudes from the left end surface of the missing tooth gear part 68 to the left, is formed in a cylindrical shape, which has a central axis line that matches the central axis line of the missing tooth gear part 68. The rotational axis 67 is inserted into the cylindrical boss 69 so as to be relatively rotatable. Accordingly, the reset gear 50 is rotatably supported with the rotational axis 67 acting as a fulcrum.

2-3. Detection Protrusion

On the left end surface of the missing tooth gear part 68 of the reset gear 50, a detection protrusion 81 is provided on a portion where the missing tooth gear part 68 has the missing tooth part 71 as the circumferential surface.

The detection protrusion 81 has a main body 811 and a swinging or pivot part 812. The main body 811, which is formed in a rectangular plate shape, protrudes from the missing tooth gear part 68 to the left in the tangential direction of a circular track drawn by the detection protrusion 81 when the reset gear 50 rotates (simply referred to below as the tangential direction). A columnar swinging axis part 813 is integrally formed at the proximal end of the swinging part 812, the central axis line of the swinging part 812 extending in the tangential direction. The swinging axis part 813, used as an example of a rotational axis, of the swinging part 812 is held to the distal end of the main body 811 so as to be rotatable about the central axis line of the main body 811. Accordingly, the detection protrusion 81 is attached so as to be changeable between a extended state (shown in FIG. 11) in which the swinging part 812 extends from the distal end of the main body 811 to the left and a collapsed state (shown in FIG. 4) in which the swinging part 812 is bent with respect to the main body 811 through 90 degrees toward the outside of the rotational radial direction of the reset gear 50.

2-4. Gear Cover

A gear cover 43 integrally has an opposite wall 82, which faces the first side wall 41 from the left side, and a circumferential wall 83, which extends toward the first side wall 41 from the circumferential edge of the opposite wall 82, as shown in FIG. 3. The gear cover 43 is made of, for example, a resin.

The opposite wall 82 has an opposite part 84, which faces the reset gear 50 from the left side as shown in FIGS. 3 and 5. The opposite part 84 has a circular shape as viewed from a side.

A round hole 85, which is a through-hole, is formed at the center of the opposite part 84. A substantially cylindrical boss part 86 is formed, which protrudes from the circumferential edge of the round hole 85 toward the inside of the gear cover 43 (to the right), as shown in FIG. 5. The part 86 is inserted into the cylindrical boss 69 of the reset gear 50 and the distal end (right end) of the part 86 is inserted into the distal end of the rotational axis 67.

On the inner surface of the opposite part 84, a recess 87, which has a circular shape concentric with the round hole 85 and is one step deeper, is formed on a side opposite to the first side wall 41 (on the left side), as shown in FIG. 5. Accordingly, a cylindrical side wall 88, which is linked to the inside and outside of the recess 86, is formed on the inner surface of the opposite part 84.

On the side wall 88, a protrusion extending cam 89 used as an example of a protrusion extending cam member is formed so as to protrude toward the inside as shown in FIGS. 2 and 5.

The protrusion extending cam 89, disposed between a position in front of the round hole 85 and a position above the round hole 85, has an arc shape having a central angle of about 90 degrees as viewed from a side, as shown in FIG. 2. The protrusion extending cam 89 is also sloped so as to separate from the first side wall 41 as the protrusion extending cam 89 approaches from the position in front of the round hole 85 to the position above the round hole 85.

The opposite part 84 used as an example of a protrusion falling cam member has a substantially arc-shaped opening 90, which extends along the side wall 88, inside the side wall 88. A spacing is provided between the round hole 85 and the inner end edge of the opening 90 in a radial direction of the opposite part 84. The inner end edge of the spacing has a semicircular part 901 in a semicircular shape and a linear part 902, used as an example of an edge, that linearly extends and is linked to the downstream of the semicircular part 901 in its rotational direction R (described later) and intersects the circular track drawn by the detection protrusion 81 when the reset gear 50 rotates.

The opposite wall 82 has an opening 91 through which the coupling part 54 of the input gear 45 is exposed.

3. Detection Mechanism

A detection mechanism 101 that detects the detection protrusion 81 is provided in the main body casing 2 as shown in FIG. 2. The detection mechanism 101 includes an actuator 102 and an optical sensor 103 that has a light emitting element and a photosensitive element.

The actuator 102 integrally has a swinging axis 104 extending in the right and left direction, an abutting lever 105 extending downward from the swinging axis 104, and a light shielding lever 106 extending backward from the swinging axis 104. The swinging axis 104 is rotatably held to, for example, the inner wall (not shown) of the main body casing 2. The abutting lever 105 and light shielding lever 106 intersect at an angle of about 80 degrees, centered around the swinging axis 104.

The actuator 102 is swingably attached so as to be changeable between a non-detecting state (state shown in FIG. 2), in which the abutting lever 105 extends forward and downward from the swinging axis 104 and the light shielding lever 106 extends backward and downward, and a detecting state (state shown in FIG. 13), in which the abutting lever 105 extends backward and the light shielding lever 106 extends backward. The actuator 102 is biased by a spring force of a spring (not shown) so that the actuator 102 is placed in the non-detecting state when external forces other than the spring force are not applied.

The optical sensor 103 has the light emitting element and photosensitive element that are placed opposite to each other in the right and left direction. An optical path of the optical sensor 103, which extends from the light emitting element to the photosensitive element, is blocked by the light shielding lever 106 of the actuator 102, and the actuator 102 placed in the detecting state is positioned at a position to which the light shielding lever 106 is retracted from the optical path. When the light shielding lever 106 is retracted (shifted) from the optical path extending from the light emitting element to the photosensitive element, an ON signal is output from the optical sensor 103.

A microcomputer (not shown) is electrically connected to the optical sensor 103.

4. Detection of a New Developing Cartridge

As shown in FIGS. 3 and 4, when the developing cartridge 7 is a new one, the detection protrusion 81 is positioned at an initial position below and in front of the cylindrical boss 69 (rotational axis 67) of the reset gear 50. In this initial state, about half of the detection protrusion 81 is placed inside the gear cover 43, and the detection protrusion 81 is placed in the collapsed state. The most downstream gear tooth 70 of the row of the gear teeth 70 of the reset gear 50 in the rotational direction R has been engaged with the gear teeth 66 of the agitator gear 49.

When the developing cartridge 7 is installed in the main body casing 2, a warm-up operation starts for the laser printer 1. In the warm-up operation, the driving output member 56 (see FIG. 2) is inserted into the coupling part 54 (linkage recess 55) of the input gear 45, and the driving force is supplied from the driving output member 56 to the input gear 45, rotating the input gear 45. Due to the rotation of the input gear 45, the developing gear 46, supply gear 47, and intermediate gear 48 are rotated and the developing roller 18 and supply roller 19 are rotated. Due to the rotation of the intermediate gear 48, the agitator gear 49 is rotated and the agitator 16 (see FIG. 1) is rotated. Due to the rotation of the agitator 16, the toner in the developing cartridge 7 is stirred.

When the new developing cartridge 7 is a new one, the gear teeth 66 of the agitator gear 49 and the gear teeth 70 of the reset gear 50 have been mutually engaged; when the agitator gear 49 is rotated, therefore, the reset gear 50 follows the rotation and is rotated in the rotational direction R, which is counterclockwise as viewed from the left side.

Before and immediately after the new developing cartridge 7 is installed in the main body casing 2, the actuator 102 is placed in a to-be-detected state as shown in FIG. 2, the abutting lever 105 faces the opening 90 of the gear cover 43 in the right and left direction, and the optical path of the optical sensor 103 is blocked by the light shielding lever 106. Thus, an OFF signal is output from the optical sensor 103.

Figure 10:
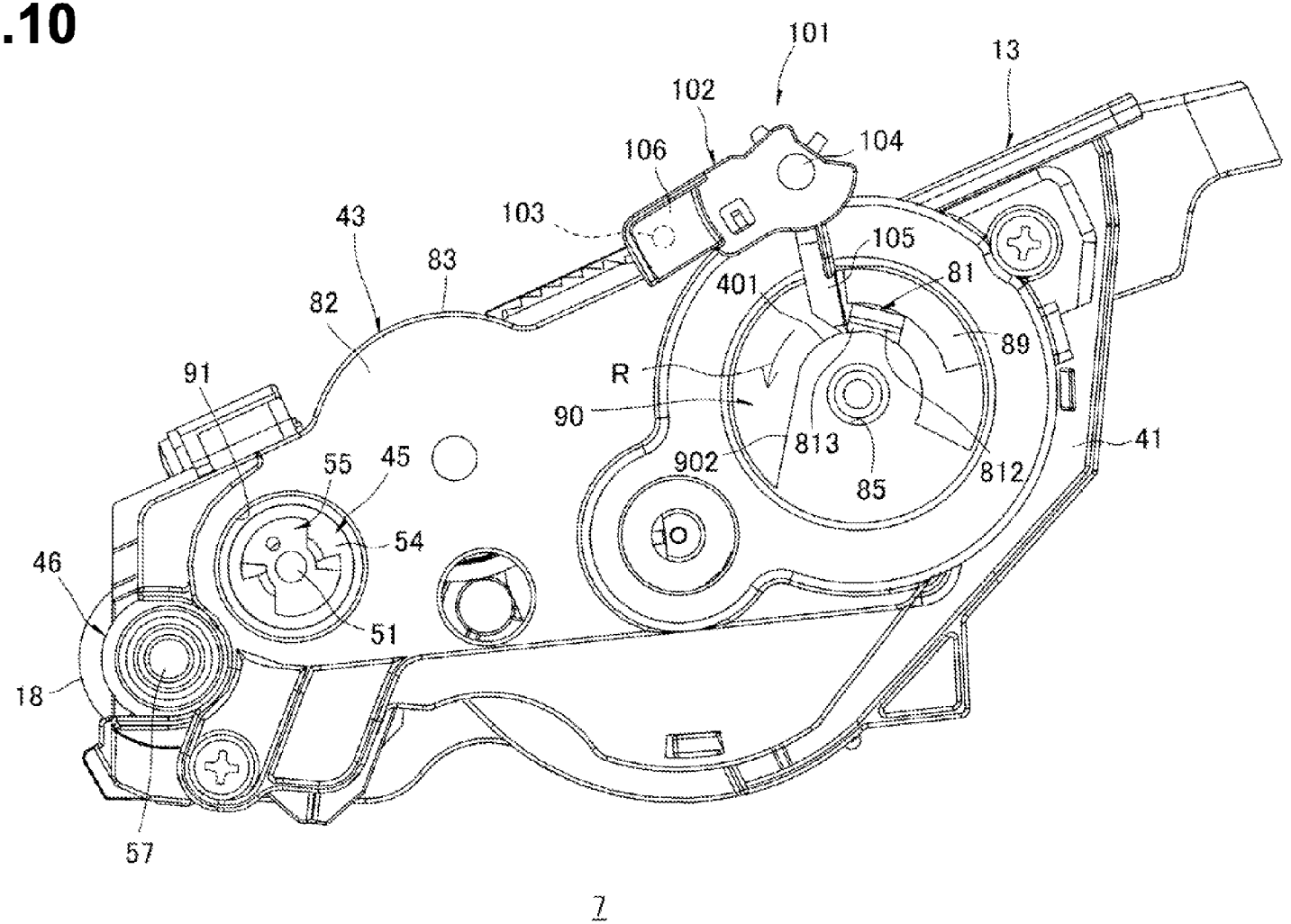
FIG. 10 is a left side view of the developing cartridge, indicating a state in which the detection protrusion is placed in a extended state.
Figure 11:
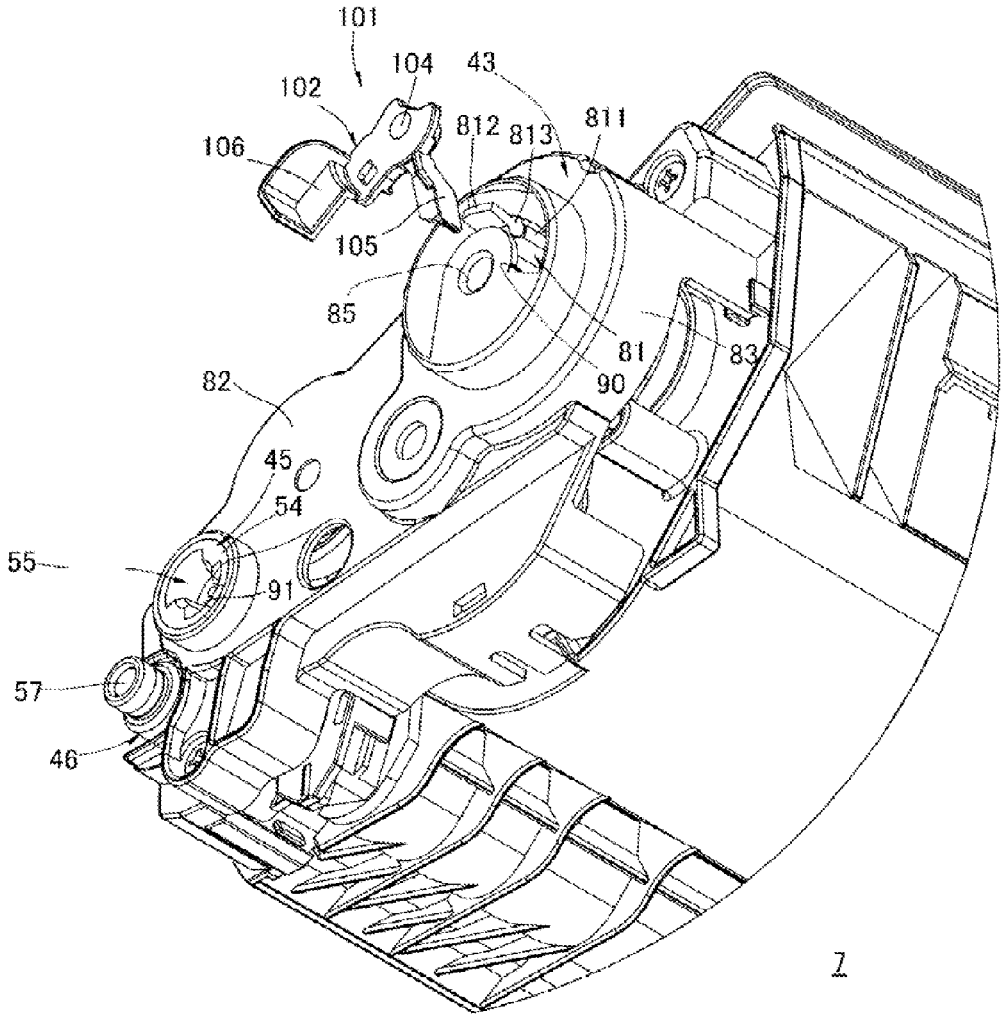
FIG. 11 is a perspective view at the left end of the developing cartridge illustrated in FIG. 10, as viewed from the bottom at the front on the left side.
Figure 12:
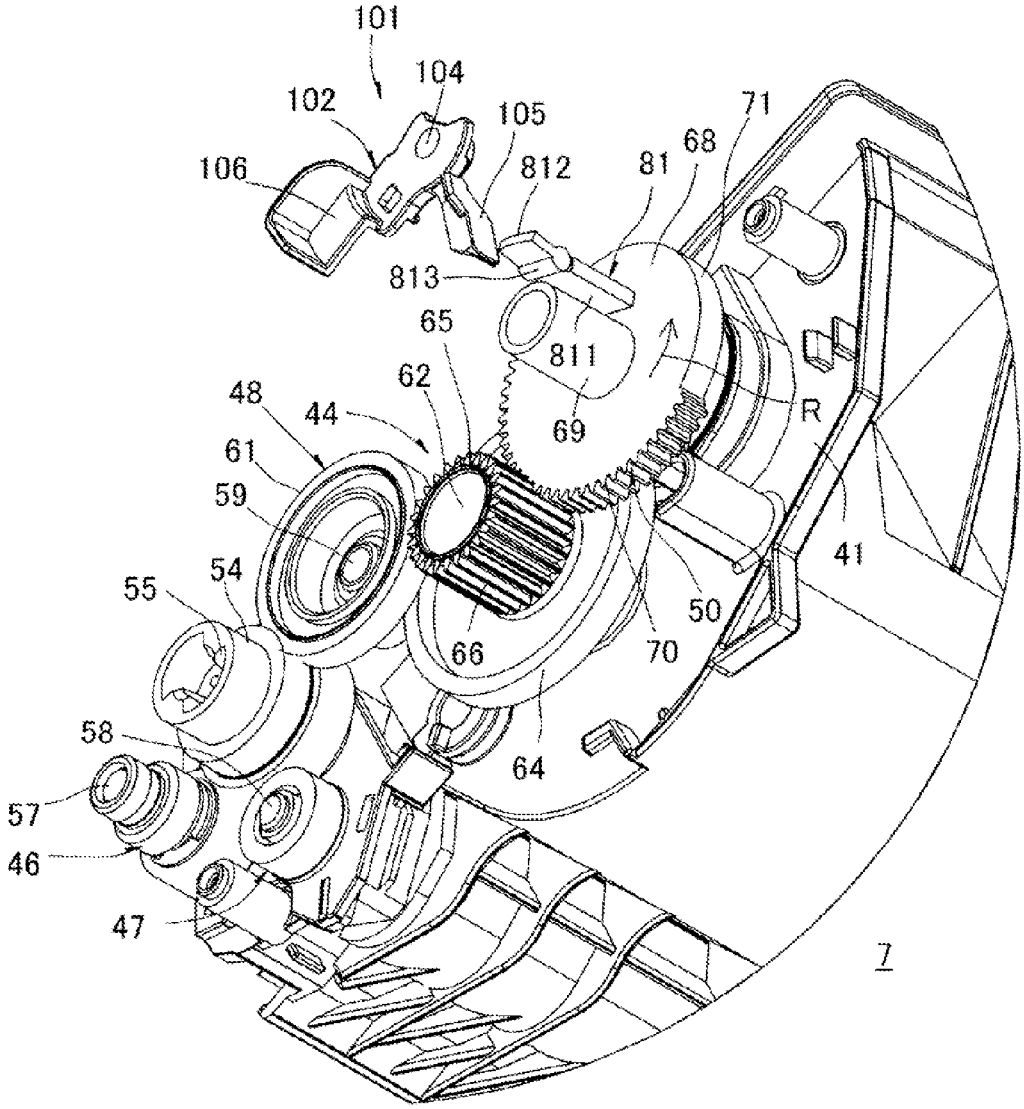
FIG. 12 is a perspective view at the left end of the developing cartridge illustrated in FIG. 10, as viewed from the bottom at the front on the left side, indicating a state in which the gear cover is removed.

When the reset gear 50 rotates, the detection protrusion 81 moves in the rotational direction R. The swinging part 812 of the detection protrusion 81 abuts the protrusion extending cam 89 during the movement as shown in FIGS. 6, 7, 8, and 9. The swinging part 812 then receives a force from the protrusion extending cam 89 during the subsequent rotation of the reset gear 50; the force causes the swinging part 812 to change from a state in which the swinging part 812 is bent with respect to the main body 811 to a state in which the swinging part 812 extends to the left. As a result, the detection protrusion 81 changes from the collapsed state to the extended state as shown in FIGS. 10, 11, and 12.

Figure 13:
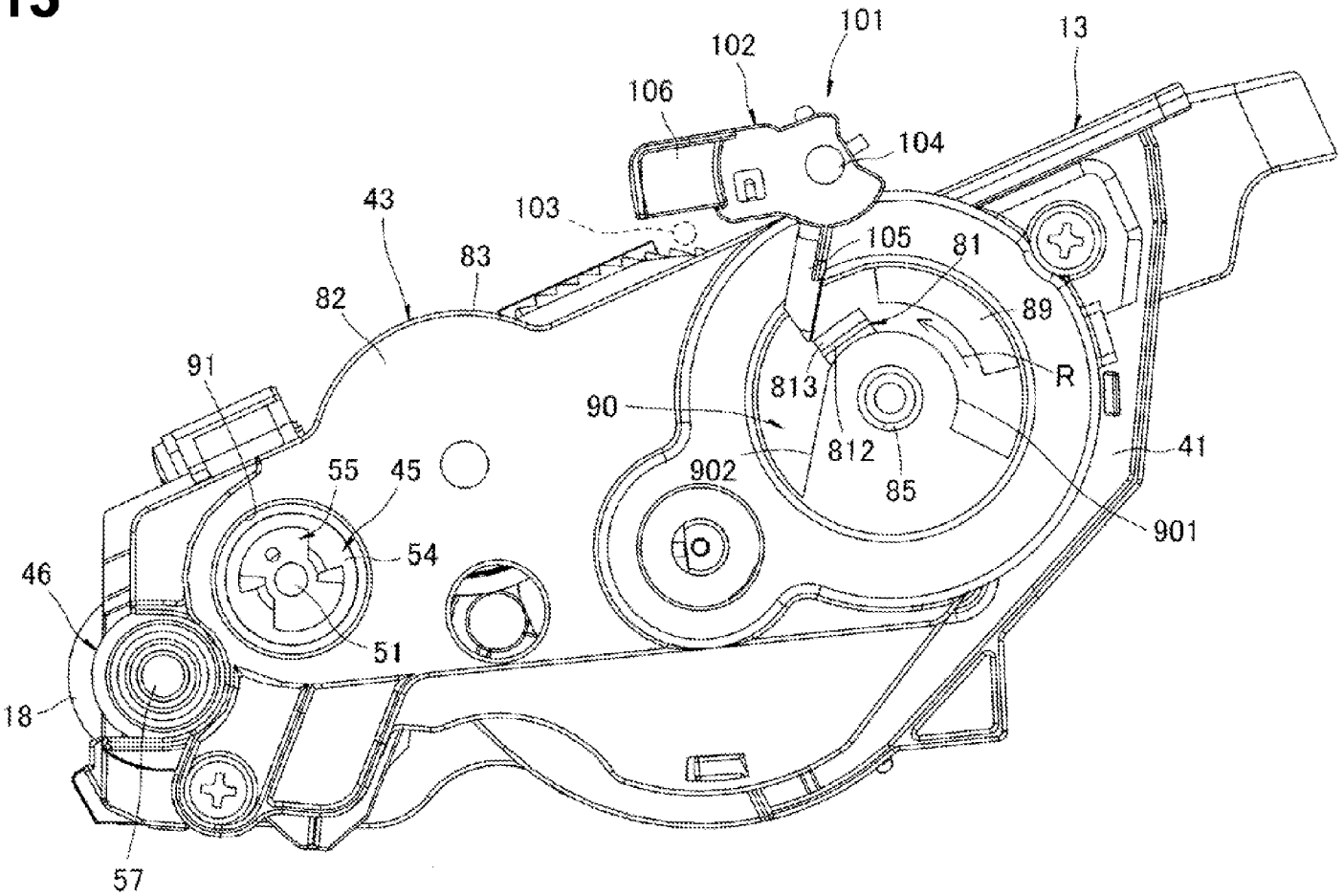
FIG. 13 is a left side view of the developing cartridge, indicating a state in which an actuator is placed in a detecting state.

When the rotation of the reset gear 50 proceeds, the detection protrusion 81 abuts the abutting lever 105. When the rotation of the reset gear 50 further proceeds, the detection protrusion 81 pushes the abutting lever 105 backward, shifting the actuator 102 from the to-be-detected state to the detecting state as shown in FIG. 13. As a result, the light shielding lever 106 is removed from the optical path of the optical sensor 103, which extends from the light emitting element to the photosensitive element, and an ON signal is output from the optical sensor 103. Accordingly, detection of the detection protrusion 81 by the optical sensor 103 is achieved.

When the reset gear 50 further rotates and the detection protrusion 81 is released from the abutting lever 105, the actuator 102 returns from the detecting state to the to-be-detected state. As a result, the optical path of the optical sensor 103, which extends from the light emitting element to the photosensitive element, is blocked by the light shielding lever 106 and the output signal from the optical sensor 103 is switched from the ON signal to an OFF signal.

Figure 14:
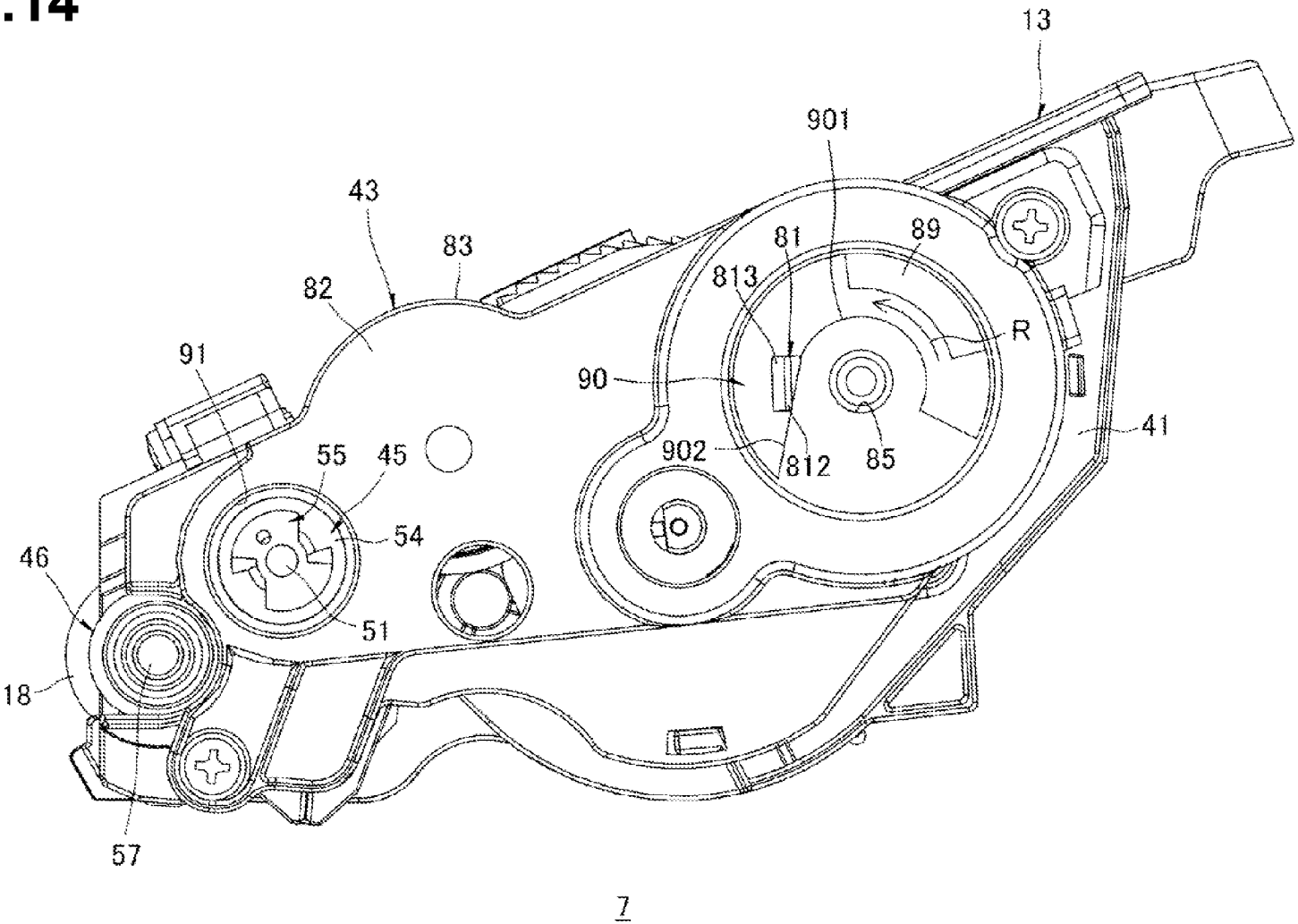
FIG. 14 is a left side view of the developing cartridge, indicating a state in which the detection protrusion is in contact with a linear portion.
Figure 15:
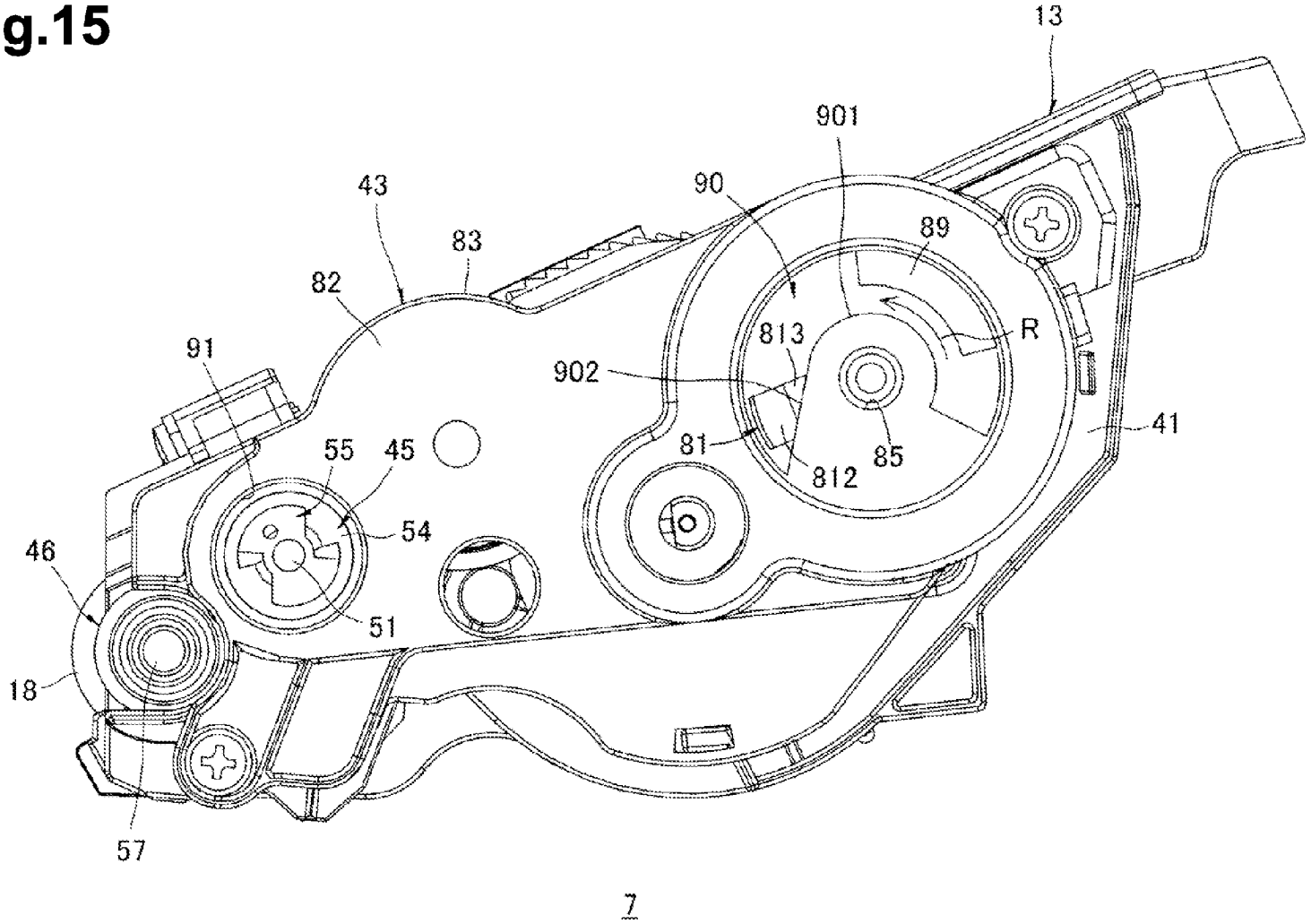
FIG. 15 is a left side view of the developing cartridge, indicating a state in which the detection protrusion is positioned at the terminal position.

When the reset gear 50 further rotates, the detection protrusion 81 abuts the downstream end edge of the opening 90 of the gear cover 43 in the rotational direction R as shown in FIG. 14, that is, the linear part 902. Due to the subsequent rotation of the reset gear 50, the detection protrusion 81 receives a force from the linear part 902. This force bends the swinging part 812 of the detection protrusion 81 toward the outside of the rotational radial direction of the reset gear 50 and protrudes into the inside of the gear cover 43. As a result, the detection protrusion 81 changes from the extended state to the collapsed state as shown in FIG. 15.

Figure 16:
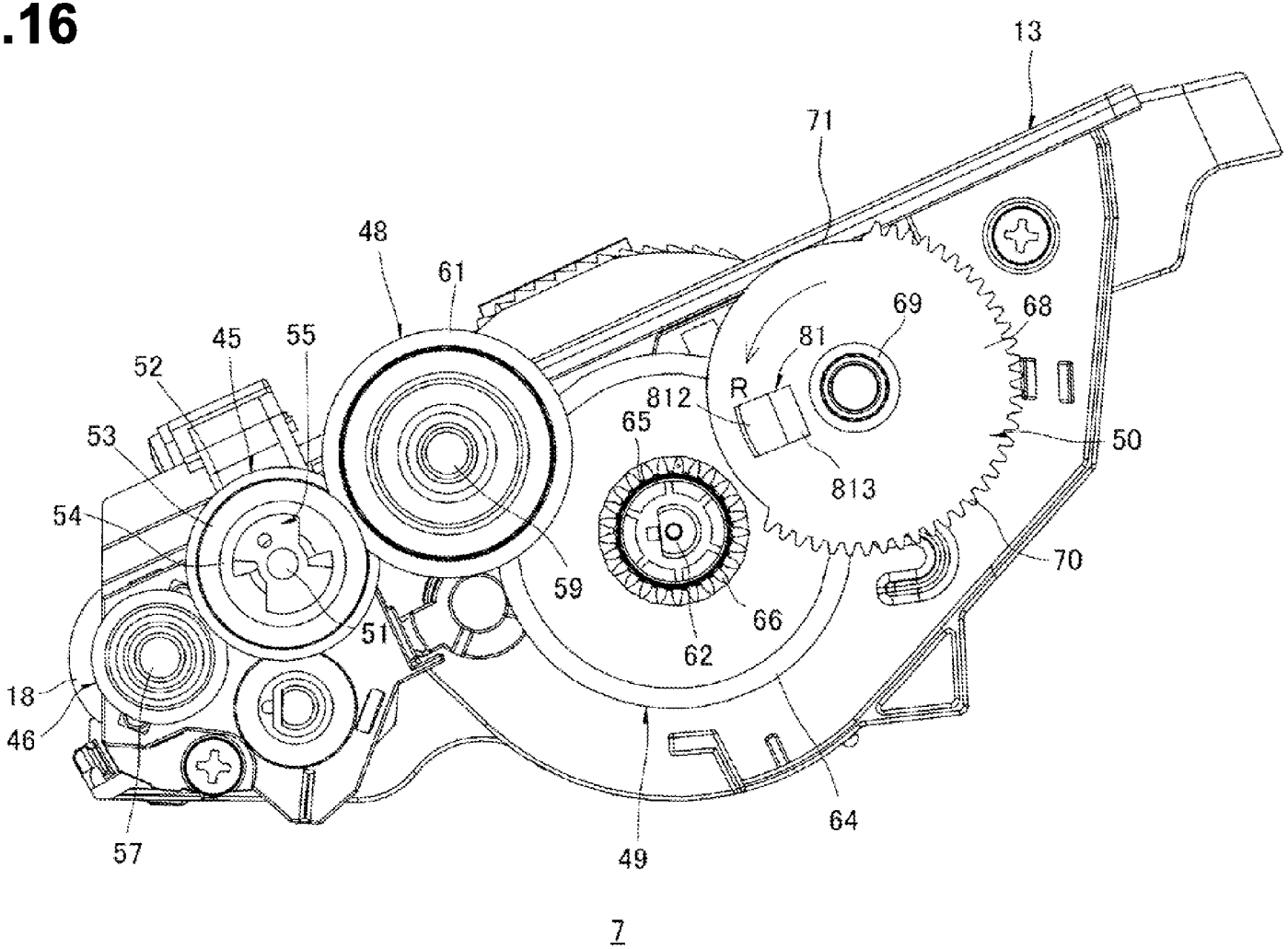
FIG. 16 is a left side view of the developing cartridge illustrated in FIG. 15, indicating a state in which the gear cover is removed.

Then, when the rotation of the reset gear 50 further proceeds, the gear teeth 70 of the reset gear 50 are disengaged from the gear teeth 66 of the agitator gear 49 and the missing tooth part 71 of the reset gear 50 faces the gear teeth 66, as shown in FIG. 16. Accordingly, the rotation of the reset gear 50 stops and the detection protrusion 81 is positioned at a terminal position.

As described above, when the new developing cartridge 7 is installed in the main body casing 2 for the first time, an ON signal is output from the optical sensor 103. Therefore, if an ON signal is output from the optical sensor 103 after the developing cartridge 7 has been installed in the main body casing 2, it can be determined that the developing cartridge 7 is a new one.

When an old developing cartridge 7 (a developing cartridge 7 that has been installed in the main body casing 2 at least once) is installed in the main body casing 2, the rotational position of the reset gear 50 is a position at which the gear teeth 70 have already been disengaged from the gear teeth 66, so even if the warm-up operation of the laser printer 1 is started, the reset gear 50 does not rotate. Therefore, if an ON signal is not output from the optical sensor 103 within a prescribed time after the developing cartridge 7 has been installed in the main body casing 2, it can be determined that the developing cartridge 7 is an old one.

As described above, the input gear 45 is provided in the casing of the developing cartridge 7. The input gear 45 is rotated by a rotation driving force supplied from the outside. When the input gear 45 rotates, the rotation driving force is output from the input gear 45. The developing cartridge 7 has the reset gear 50 that receives the rotation driving force output from the input gear 45 and rotates.

The detection protrusion 81 is provided at a position apart from the rotational center of the reset gear 50. The detection protrusion 81 is changeable between the extended state and the collapsed state with respect to the reset gear 50.

If the detection protrusion 81 is placed in the collapsed state when, for example, the developing cartridge 7 is installed in or removed from the main body casing, the detection protrusion 81 can be made less likely to come into contact with other members and the wear and damage of the detection protrusion 81, which is caused by the contact, can thereby be reduced.

Even if the detection protrusion 81 is placed in the extended state, when the detection protrusion 81 abuts another member and a force is applied to the detection protrusion 81, the detection protrusion 81 changes from the extended state to the collapsed state. Accordingly, it can be reduced that the detection protrusion 81 is strongly rubbed and the wear of the detection protrusion 81 can thereby be reduced. Since the force applied to the detection protrusion 81 can be released, the damage to the detection protrusion 81 can also be reduced.

The detection protrusion 81 is placed in the collapsed state at the initial position, which is a position before the reset gear 50 rotates, that is, in a state in which the detection protrusion 81 is positioned at the initial position before the reset gear 50 receives the rotation driving force from the input gear 45.

Accordingly, the detection protrusion 81 can be made less likely to come into contact with other members when, for example, the developing cartridge 7 is carried or the developing cartridge 7 is installed in the main body casing 2, and the wear and damage of the detection protrusion 81, which is caused by the contact, can thereby be reduced.

The detection protrusion 81 is provided so as to be rotatable about the swinging axis part 813. The swinging axis part 813 extends in the tangential direction of the circular track drawn by the detection protrusion 81 when the reset gear 50 rotates.

Accordingly, the detection protrusion 81 can be made changeable between the state in which the detection protrusion 81 stands on the circular track and the state in which the detection protrusion 81 falls down in a radial direction of the circular track.

The developing cartridge 7 has the protrusion extending cam 89, which is used to change the detection protrusion 81 from the collapsed state to the extended state.

Accordingly, when the reset gear 50 is rotated after the developing cartridge 7 has been installed in the main body casing 2, the detection protrusion 81 can be changed from the collapsed state to the extended state, enabling the detection mechanism 101 to detect the detection protrusion 81 placed in the extended state.

The developing cartridge 7 has the agitator gear 49 used to transmit the rotation driving force, which is output from the input gear 45, to the reset gear 50. The missing tooth gear part 68 to which the rotation driving force is transmitted from the agitator gear 49 is formed on the reset gear 50. The transmission of the rotation driving force from the agitator gear 49 to the missing tooth gear part 68 is discontinued at least when the detection protrusion 81 is positioned at the terminal position.

Accordingly, it is possible to stop the detection protrusion 81 at the terminal position and to maintain the state in which the detection protrusion 81 is stopping at the terminal position.

The developing cartridge 7 has the opposite part 84 with the linear part 902 used to change the detection protrusion 81 from the extended state to the collapsed state.

Accordingly, it is possible to change the detection protrusion 81 from the extended state to the collapsed state and place the detection protrusion 81 in the collapsed state at the terminal position. When the developing cartridge 7 is removed from the main body casing 2, therefore, the detection protrusion 81 is made less likely to come into contact with other members and the wear and damage of the detection protrusion 81, which is caused by the contact, can thereby be reduced.

The linear part 902 intersects a circular track drawn by a portion of the detection protrusion 81, which moves when the reset gear 50 rotates, the portion first abutting the protrusion falling cam member. When the detection protrusion 81 moves while sliding on the linear part 902 due to the rotation of the reset gear 50, the detection protrusion 81 superiorly changes from the extended state to the collapsed state.

Although an embodiment of the present disclosure has been described so far, the present disclosure is not limited to the structure described above.

In the structure described above, the detection protrusion 81 is placed in the collapsed state with it positioned at the terminal position, as shown in FIG. 15.

Figure 17:
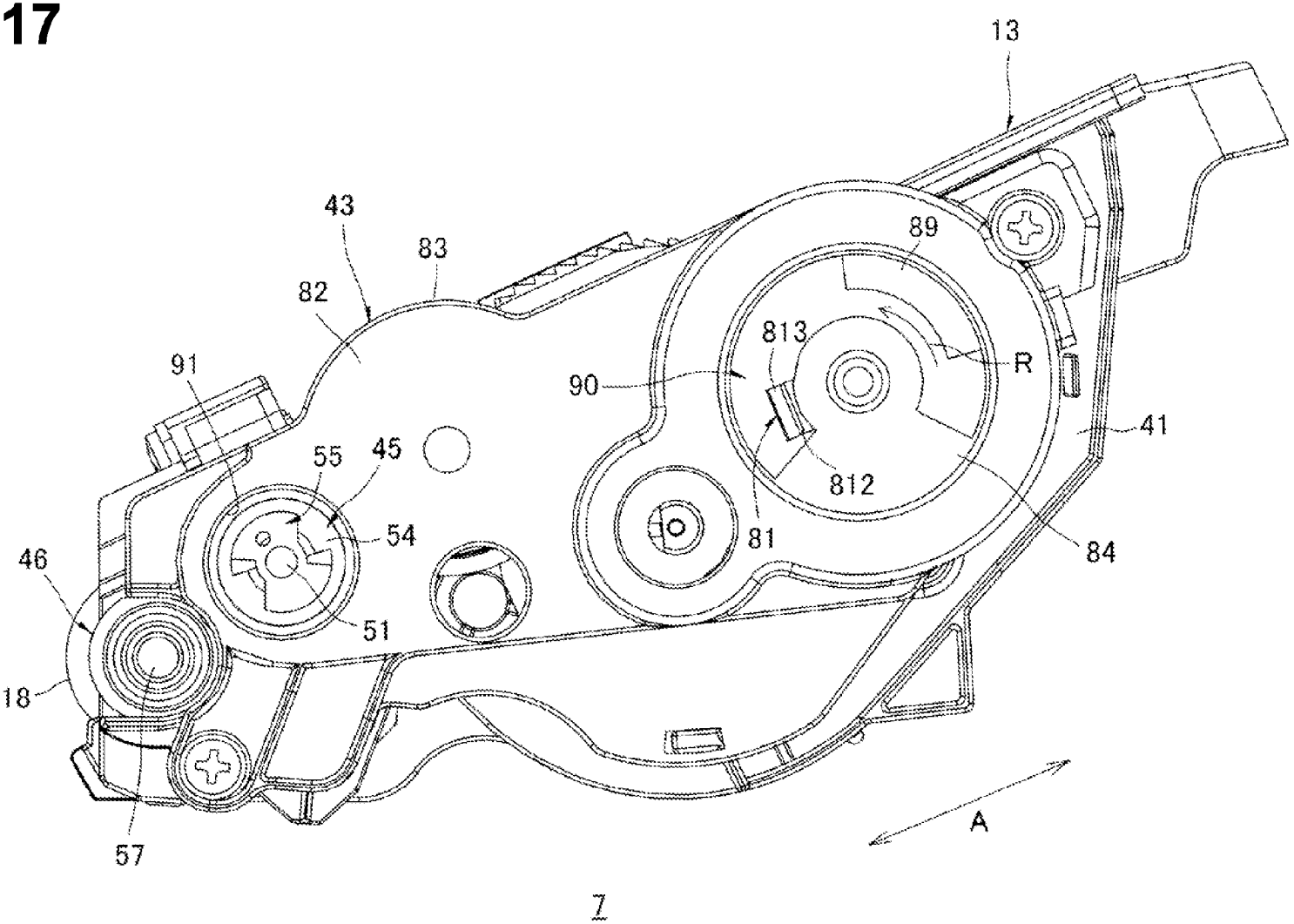
FIG. 17 is a left side view of a developing cartridge in a variation.

As shown in FIG. 17, however, the detection protrusion 81 may be placed in the extended state with it positioned at the terminal position. In this case, it is desirable to predetermine the terminal position so that with the detection protrusion 81 positioned at the terminal position, the central axial line of the swinging axis part 813 extends in a direction substantially orthogonal to a direction A in which the developing cartridge 7 is installed in and removed from the main body casing 2.

Accordingly, when the developing cartridge 7 is removed from the main body casing 2, if the detection protrusion 81 abuts another member and a force is applied to the detection protrusion 81, the detection protrusion 81 changes from the extended state to the collapsed state. Therefore, it can be reduced that the detection protrusion 81 is strongly rubbed and the wear of the detection protrusion 81 can thereby be reduced. Since the force applied to the detection protrusion 81 can be released, the damage to the detection protrusion 81 can also be reduced.

In addition, in the structure according to the embodiment described above, the reset gear 50 has the missing tooth gear part 68 and the gear teeth 70 are formed on the outer circumferential surface of the missing tooth gear part 68.

Figure 18:
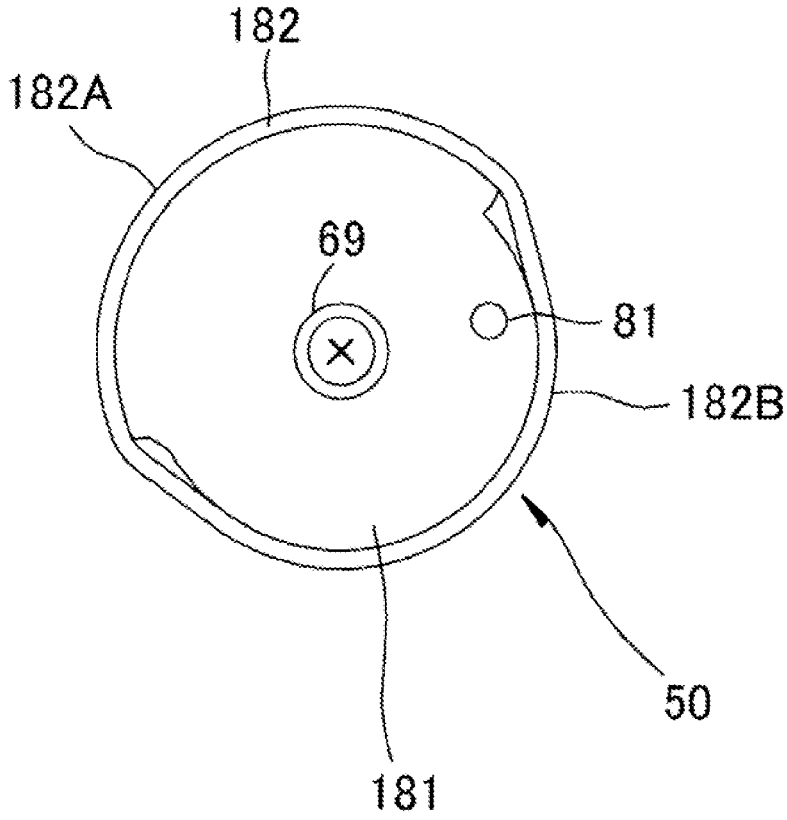
FIG. 18 is a schematic side view illustrating a structure (structure used instead of a missing tooth gear part of a reset gear) according to the variation.

Instead of the missing tooth gear part 68, a main body 181 in a sector plate shape centered around the cylindrical boss 69 and a resistance applying member 182 wound on the outer circumference of the main body 181 may be provided as shown in FIG. 18, at least the outer circumferential surface of the resistance applying member 182 being made of rubber or another material having a relatively large frictional coefficient. In this case, gear teeth may or may not be formed on the circumferential surface of the small-diameter gear part 65 of the agitator gear 49. The main body 181 and resistance applying member 182 are formed so as to have a size that prevents a portion 182B, which is formed on the outer circumferential surface of the resistance applying member 182 and is recessed relatively inside in a radial direction, from coming into contact with the small-diameter gear part 65 and allows an arc surface 182A, which is formed on the outer circumferential surface of the resistance applying member 182 and is placed relatively outside in a radial direction, to come into contact with the circumferential surface of the small-diameter gear part 65.

Although the developing cartridge 7 in the structure according to the embodiment described above has the gear cover 43, the gear teeth 70 may be eliminated (a structure in which the reset gear 50 is exposed may be used) as long as the detection protrusion 81 provided on the reset gear 50 is changeable between the extended state and the collapsed state.

While certain aspects of the disclosure have been shown and described with reference to certain illustrative embodiments thereof, it will be understood by those skilled in the art that various changes in form and details may be made therein without departing from the spirit and scope of the invention as defined by the appended claims.

The invention claimed is:

1. A cartridge comprising:

a housing;

a driving input member provided at the housing, the driving input member configured to be rotated by an externally supplied rotation driving force;

a rotational member configured to receive the rotation driving force, which is transmitted from the driving input member, and be rotated thereby; and a detection protrusion provided at a position away from a rotational center of the rotational member, the detection protrusion including:

a main body protruding from the rotational member away from the housing; and a pivot part configured to pivot relative to the main body, wherein the detection protrusion is configured to be changeable between an extended state and a collapsed state with respect to the rotational member, and wherein an end portion of the pivot part is located closer to the rotational member when the detection protrusion is in the collapsed state than when the detection protrusion is in the extended state.

2. The cartridge according to claim 1, wherein the detection protrusion is placed in the collapsed state at an initial position, the initial position corresponding to a position of the detection protrusion before the rotational member rotates.

3. The cartridge according to claim 1, wherein:

the detection protrusion is configured to pivot between the extended state and the collapsed state, via a pivot axis; and the pivot axis extends in a direction of a tangent line of a circular track drawn by the detection protrusion when the rotational member rotates.

4. The cartridge according to claim 3, further comprising a protrusion extending cam configured to change the detection protrusion from the collapsed state to the extended state.

5. The cartridge according to claim 3, further comprising:

a transmitting member configured to transmit the rotation driving force, transmitted from the driving input member, to the rotational member, wherein the rotational member further includes a passive part, the rotation driving force being transmitted from the transmitting member to the passive part, and wherein the detection protrusion is configured to move from an initial position to a terminal position when the rotational member rotates, and transmission of the rotation driving force from the transmitting member to the passive part is discontinued at least when the detection protrusion is positioned at the terminal position.

6. The cartridge according to claim 5, wherein the cartridge is configured to be installed in and removed from a main body casing in a prescribed installing and removing direction, and wherein the pivot axis is substantially perpendicular to the prescribed installing and removing direction when the detection protrusion is positioned at the terminal position.

7. The cartridge according to claim 3, further comprising a protrusion collapsing cam configured to change the detection protrusion from the extended state to the collapsed state.

8. The cartridge according to claim 7, wherein the protrusion collapsing cam includes an edge that intersects a circular track drawn by a portion of the detection protrusion, which is configured to move when the rotational member rotates, the portion of the detection protrusion configured to first abut the protrusion collapsing cam member.

9. The cartridge according to claim 1, wherein the pivot part pivots around a pivot axis substantially perpendicular to a direction in which the main body protrudes from the rotational member.

10. A cartridge comprising:

a housing;

a driving input member provided in the housing, the driving input member configured to be rotated by an externally supplied rotation driving force;

a rotational member configured to receive the rotation driving force, transmitted from the driving input member, and be rotated thereby;

a cover attached to the housing, the cover having an opposite part that faces the rotational member; and a detection protrusion provided at a position away from a rotational center of the rotational member, the detection protrusion including:

a main body which protrudes from a face of the rotational member; and a pivot part configured to pivot relative to the main body in at least a direction orthogonal to a rotational plane in which the rotational member is configured to move, wherein the detection protrusion is configured to be changeable between an extended state and a collapsed state; and wherein, at an initial position, corresponding to a position before the rotational member is rotated, and at a terminal position, corresponding to a position after the rotational member has performed a complete rotation, the opposite part of the cover is configured to contact the detection protrusion and change the detection protrusion from the collapsed state to the extended state, wherein, at a point between the initial position and the terminal position, the detection protrusion is configured to extend through a hole in the opposite part of the cover and to assume the extended state, wherein the hole extends in the direction orthogonal to the rotational plane.

11. The cartridge according to claim 10, further comprising:

a transmission gear configured to transmit the rotation driving force, transmitted from the driving input member, to the rotational member, wherein the rotational member includes a set of gear teeth formed on a first portion of a circumferential surface of the rotational member, wherein no gear teeth are formed on a remainder of the circumferential surface of the rotational member, wherein, when the detection protrusion arrives at the terminal position, the transmission of the rotation driving force from the transmission gear to the rotational member is discontinued by the transmission gear disengaging from the gear teeth of the first portion of the circumferential surface of the rotational member.

12. The cartridge according to claim 10, further comprising: a protrusion extending cam configured to change the detection protrusion from the collapsed state to the extended state.

13. The cartridge according to claim 10, further comprising: a protrusion collapsing cam configured to change the detection protrusion from the extended state to the collapsed state.

14. A cartridge comprising:

a housing;

a driving input member provided of the housing, the driving input member configured to be rotated by an externally supplied rotation driving force;

a rotational member configured to receive the rotation driving force, which is transmitted from the driving input member, and be rotated thereby;

a cover attached to the housing, the cover having an opposite part that faces the rotational member; and a detection protrusion provided at a position away from a rotational center of the rotational member, wherein the detection protrusion is configured to be changeable between:

an extended state in which a pivot part of the detection protrusion is positioned at first orientation relative to a main body of the detection protrusion, and a collapsed state in which the pivot part is positioned at second orientation relative to the main body, which is different than the first orientation, wherein, at least a portion of the detection protrusion is configured to pivot about a pivot axis that is substantially parallel to a face of the rotational member that faces the cover in order to assume each of the extended state and the collapsed state.

* * * * *